US009618879B2

(12) United States Patent
Noda et al.

(10) Patent No.: US 9,618,879 B2
(45) Date of Patent: Apr. 11, 2017

(54) DEVELOPING CARTRIDGE

(71) Applicant: Brother Kogyo Kabushiki Kaisha, Nagoya-shi, Aichi-ken (JP)

(72) Inventors: Ryuji Noda, Seto (JP); Hirofumi Kuriki, Nagoya (JP); Keita Shimizu, Tsushima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/589,696

(22) Filed: Jan. 5, 2015

(65) Prior Publication Data

US 2015/0192880 A1 Jul. 9, 2015

(30) Foreign Application Priority Data

Jan. 6, 2014 (JP) ..... 2014-000609

(51) Int. Cl.
*G03G 15/08* (2006.01)
*G03G 21/18* (2006.01)
*G03G 21/16* (2006.01)

(52) U.S. Cl.
CPC ..... *G03G 15/0889* (2013.01); *G03G 21/1647* (2013.01); *G03G 21/1676* (2013.01);
(Continued)

(58) Field of Classification Search
CPC ..... G03G 15/0889; G03G 21/1857; G03G 15/0935; G03G 2221/163; G03G 2221/1633; G03G 2221/1657
(Continued)

(56) References Cited

U.S. PATENT DOCUMENTS 4,974,020 A 11/1990 Takamatsu et al.
5,053,816 A 10/1991 Takahashi
(Continued)

FOREIGN PATENT DOCUMENTS

AU 2010281279 B2 2/2014
CN 1445624 A 10/2003
(Continued)

OTHER PUBLICATIONS

Apr. 26, 2011—(WO) International Search Report (JPO)—App PCT/JP2011/057946.
(Continued)

*Primary Examiner* — Christopher Mahoney
(74) *Attorney, Agent, or Firm* — Banner & Witcoff, Ltd.

(57) ABSTRACT

A developing cartridge includes: an agitation member configured to be rotatable around a rotational shaft extending in a first direction and to agitate a developer; an agitation gear being fixed to the agitation member and including a first gear configured to receive driving force to be inputted and a second gear positioned on one side of the first gear in the first direction; a detection target unit including a detection target receiving portion configured to receive the driving force from the second gear and a detection target portion configured to be detected by an external detecting apparatus; and a gear cover configured to cover at least a part of the agitation gear and the detection target unit therewith. The detection target portion is configured to move between the second gear and the gear cover when being projected in a direction orthogonal to the first direction.

13 Claims, 10 Drawing Sheets

(52) U.S. Cl.
CPC . *G03G 21/1857* (2013.01); *G03G 2221/1657* (2013.01); *G03G 2221/1663* (2013.01)

(58) Field of Classification Search
USPC ..... 399/12
See application file for complete search history.

(56) References Cited

U.S. PATENT DOCUMENTS

| | | | | |
|---|---|---|---|---|
| 5,489,976 | A | 2/1996 | Ichikawa | |
| 5,495,323 | A | 2/1996 | Meetze, Jr. | |
| 5,495,327 | A | 2/1996 | Inomata | |
| 5,640,651 | A | 6/1997 | Katoh et al. | |
| 5,649,264 | A | 7/1997 | Domon et al. | |
| 5,970,293 | A | 10/1999 | Huang | |
| 6,088,561 | A | 7/2000 | Kawamura et al. | |
| 6,154,619 | A | 11/2000 | Boockholdt et al. | |
| 6,714,224 | B2 | 3/2004 | Yamanaka et al. | |
| 6,792,217 | B2 | 9/2004 | Nishino et al. | |
| 6,823,160 | B2 | 11/2004 | Okabe | |
| 6,829,465 | B2 | 12/2004 | Yamanaka et al. | |
| 6,903,759 | B2 | 6/2005 | Yamanaka et al. | |
| 6,909,866 | B2 | 6/2005 | Kawai | |
| 6,920,303 | B2 | 7/2005 | Yamanaka et al. | |
| 7,116,919 | B2 | 10/2006 | Ishii | |
| 7,130,551 | B2 | 10/2006 | Kobayashi | |
| 7,418,214 | B2 | 8/2008 | Yoshida et al. | |
| 7,463,834 | B2 | 12/2008 | Takagi et al. | |
| 7,509,075 | B2 | 3/2009 | Hayakawa | |
| 7,512,347 | B2 | 3/2009 | Suzuki et al. | |
| 7,536,117 | B2 | 5/2009 | Kishi | |
| 7,613,414 | B2 | 11/2009 | Kamimura | |
| 7,643,777 | B2 | 1/2010 | Matsumoto et al. | |
| 7,756,426 | B2 | 7/2010 | Kamimura | |
| 7,933,536 | B2 | 4/2011 | Ogawa | |
| 7,953,330 | B2 | 5/2011 | Ishikawa | |
| 8,010,026 | B2 | 8/2011 | Kobayashi et al. | |
| RE42,796 | E | 10/2011 | Ishii | |
| 8,090,272 | B2 | 1/2012 | Ishikawa | |
| 8,099,025 | B2 | 1/2012 | Ishikake | |
| 8,126,366 | B2 | 2/2012 | Hattori | |
| 8,417,130 | B2 | 4/2013 | Hashimoto | |
| 8,463,145 | B2 | 6/2013 | Ukai et al. | |
| 8,583,009 | B2 | 11/2013 | Takagi | |
| 8,600,244 | B2 | 12/2013 | Hashimoto | |
| 8,620,180 | B2 * | 12/2013 | Shiraki et al. | 399/111 |
| 8,666,293 | B2 | 3/2014 | Mushika et al. | |
| 8,676,064 | B2 | 3/2014 | Takagi | |
| 8,712,286 | B2 | 4/2014 | Takagi | |
| 8,744,288 | B2 | 6/2014 | Shinoya et al. | |
| 8,761,643 | B2 | 6/2014 | Mushika et al. | |
| 8,849,133 | B2 | 9/2014 | Itabashi et al. | |
| 8,867,932 | B2 | 10/2014 | Ukai et al. | |
| 8,948,617 | B2 | 2/2015 | Shiraki et al. | |
| 8,948,661 | B2 | 2/2015 | Mushika et al. | |
| 9,195,207 | B2 | 11/2015 | Itabashi | |
| 9,207,567 | B2 | 12/2015 | Mushika et al. | |
| 2003/0185579 | A1 | 10/2003 | Nishino et al. | |
| 2003/0185594 | A1 | 10/2003 | Okabe | |
| 2003/0215265 | A1 | 11/2003 | Kawai | |
| 2006/0034625 | A1 | 2/2006 | Kajikawa | |
| 2006/0104670 | A1 | 5/2006 | Nishitani et al. | |
| 2006/0165423 | A1 | 7/2006 | Nishitani et al. | |
| 2006/0171737 | A1 | 8/2006 | Nishimura et al. | |
| 2006/0193643 | A1 | 8/2006 | Takagi et al. | |
| 2006/0193646 | A1 | 8/2006 | Suzuki et al. | |
| 2006/0245787 | A1 | 11/2006 | Ito et al. | |
| 2007/0031158 | A1 | 2/2007 | Kamimura | |
| 2007/0041747 | A1 | 2/2007 | Kim et al. | |
| 2007/0059018 | A1 | 3/2007 | Tokuda | |
| 2007/0059038 | A1 | 3/2007 | Shiraki | |
| 2007/0077101 | A1 | 4/2007 | Tamura et al. | |
| 2007/0122165 | A1 | 5/2007 | Igarashi et al. | |
| 2007/0140709 | A1 | 6/2007 | Yoshida et al. | |
| 2007/0140725 | A1 | 6/2007 | Kamimura | |
| 2007/0253748 | A1 | 11/2007 | Matsumoto et al. | |
| 2008/0080904 | A1 | 4/2008 | Murayama et al. | |
| 2008/0205911 | A1 * | 8/2008 | Ishikawa et al. | 399/12 |
| 2008/0205928 | A1 | 8/2008 | Ishikawa | |
| 2008/0205931 | A1 | 8/2008 | Ishikawa | |
| 2008/0223173 | A1 | 9/2008 | Ishikawa | |
| 2008/0317509 | A1 | 12/2008 | Mori | |
| 2009/0000423 | A1 | 1/2009 | Ishikawa et al. | |
| 2009/0052911 | A1 | 2/2009 | Richey et al. | |
| 2009/0084210 | A1 | 4/2009 | Tsukada et al. | |
| 2009/0169247 | A1 | 7/2009 | Hattori | |
| 2009/0257782 | A1 | 10/2009 | Ishikake | |
| 2009/0269085 | A1 * | 10/2009 | Ukai | 399/12 |
| 2009/0269086 | A1 | 10/2009 | Mikuni | |
| 2009/0285604 | A1 | 11/2009 | Nakajima | |
| 2009/0297226 | A1 | 12/2009 | Nagashima et al. | |
| 2010/0054763 | A1 | 3/2010 | Tomiyori et al. | |
| 2010/0209144 | A1 | 8/2010 | Nieda | |
| 2011/0023368 | A1 | 2/2011 | Mizutani et al. | |
| 2011/0038649 | A1 | 2/2011 | Miyabe et al. | |
| 2011/0081163 | A1 | 4/2011 | Lee | |
| 2011/0123231 | A1 | 5/2011 | Ozawa et al. | |
| 2011/0236062 | A1 | 9/2011 | Takagi | |
| 2011/0236065 | A1 | 9/2011 | Takagi | |
| 2011/0236066 | A1 | 9/2011 | Takagi | |
| 2011/0243578 | A1 | 10/2011 | Ukai et al. | |
| 2012/0014713 | A1 | 1/2012 | Murakami et al. | |
| 2012/0051795 | A1 | 3/2012 | Mushika et al. | |
| 2012/0057905 | A1 | 3/2012 | Itabashi | |
| 2012/0134688 | A1 * | 5/2012 | Hashimoto | 399/12 |
| 2012/0148297 | A1 | 6/2012 | Peng et al. | |
| 2012/0177398 | A1 | 7/2012 | Takigawa | |
| 2012/0243882 | A1 * | 9/2012 | Carot | 399/12 |
| 2012/0251165 | A1 | 10/2012 | Mushika et al. | |
| 2012/0251216 | A1 | 10/2012 | Mushika | |
| 2012/0321345 | A1 | 12/2012 | Shinoya et al. | |
| 2013/0051813 | A1 | 2/2013 | Itabashi et al. | |
| 2013/0051814 | A1 | 2/2013 | Itabashi et al. | |
| 2013/0051815 | A1 | 2/2013 | Itabashi et al. | |
| 2013/0051816 | A1 | 2/2013 | Itabashi | |
| 2013/0051833 | A1 | 2/2013 | Itabashi et al. | |
| 2013/0084083 | A1 | 4/2013 | Itabashi et al. | |
| 2013/0136460 | A1 | 5/2013 | Shiraki et al. | |
| 2013/0170844 | A1 | 7/2013 | Itabashi | |
| 2013/0170845 | A1 | 7/2013 | Itabashi | |
| 2013/0259528 | A1 | 10/2013 | Yamamoto | |
| 2013/0272724 | A1 | 10/2013 | Ukai et al. | |
| 2014/0020489 | A1 | 1/2014 | Nozaki et al. | |
| 2014/0086638 | A1 | 3/2014 | Sato | |
| 2014/0169835 | A1 | 6/2014 | Nakajima | |
| 2014/0219690 | A1 | 8/2014 | Li et al. | |
| 2014/0294403 | A1 | 10/2014 | Shimizu | |
| 2014/0341617 | A1 | 11/2014 | Mushika et al. | |
| 2014/0363189 | A1 | 12/2014 | Hashimoto et al. | |
| 2014/0376968 | A1 | 12/2014 | Yamamoto et al. | |
| 2015/0000443 | A1 | 1/2015 | Shimizu | |
| 2015/0003844 | A1 | 1/2015 | Ukai et al. | |
| 2015/0005134 | A1 | 1/2015 | Shimizu | |
| 2015/0010334 | A1 | 1/2015 | Nakajima | |
| 2015/0037071 | A1 | 2/2015 | Yamamoto | |
| 2015/0043944 | A1 | 2/2015 | Yamamoto | |
| 2015/0104222 | A1 | 4/2015 | Mushika et al. | |
| 2015/0117873 | A1 * | 4/2015 | Mori et al. | 399/12 |
| 2015/0117906 | A1 * | 4/2015 | Mori | 399/254 |
| 2015/0153675 | A1 | 6/2015 | Itabashi et al. | |

FOREIGN PATENT DOCUMENTS

| | | | |
|---|---|---|---|
| CN | 1828447 | A | 9/2006 |
| CN | 1288515 | C | 12/2006 |
| CN | 2884266 | Y | 3/2007 |
| CN | 1983078 | A | 6/2007 |
| CN | 101063855 | A | 10/2007 |
| CN | 200962188 | Y | 10/2007 |
| CN | 101256379 | A | 9/2008 |
| CN | 101295157 | A | 10/2008 |
| CN | 201170840 | Y | 12/2008 |
| CN | 100476636 | C | 4/2009 |
| CN | 201222170 | Y | 4/2009 |
| CN | 101625537 | B | 1/2010 |

(56) References Cited

FOREIGN PATENT DOCUMENTS

| | | | |
|---|---|---|---|
| CN | 201402371 | Y | 2/2010 |
| CN | 201464807 | U | 5/2010 |
| CN | 201489284 | U | 5/2010 |
| CN | 202102251 | U | 1/2012 |
| CN | 202472249 | U | 10/2012 |
| CN | 102799090 | A | 11/2012 |
| CN | 202649679 | U | 1/2013 |
| CN | 203673223 | U | 6/2014 |
| EP | 0838733 | A2 | 4/1998 |
| EP | 1696278 | A2 | 8/2006 |
| EP | 1696278 | A3 | 8/2006 |
| EP | 1965268 | A1 | 9/2008 |
| EP | 1965274 | A2 | 9/2008 |
| EP | 1995644 | A2 | 11/2008 |
| EP | 2093619 | A1 | 8/2009 |
| EP | 2369422 | A1 | 9/2011 |
| EP | 2378378 | A2 | 10/2011 |
| EP | 2463723 | A1 | 6/2012 |
| EP | 2463723 | A4 | 6/2012 |
| EP | 2574991 | A2 | 4/2013 |
| EP | 2574992 | A2 | 4/2013 |
| EP | 2574993 | A2 | 4/2013 |
| HK | 1090991 | A1 | 11/2009 |
| JP | S6183570 | A | 4/1986 |
| JP | S63-118042 | U | 7/1988 |
| JP | H01205175 | A | 8/1989 |
| JP | H02-78949 | U | 6/1990 |
| JP | H02-262168 | A | 10/1990 |
| JP | H03-212656 | A | 9/1991 |
| JP | H04-31156 | U | 3/1992 |
| JP | H04-191773 | A | 7/1992 |
| JP | H04-112263 | U | 9/1992 |
| JP | H04-114057 | U | 10/1992 |
| JP | 5323696 | B2 | 12/1993 |
| JP | 06-208301 | A | 7/1994 |
| JP | H07-140776 | A | 6/1995 |
| JP | H07-281519 | | 10/1995 |
| JP | H08-179608 | A | 7/1996 |
| JP | H08-248838 | A | 9/1996 |
| JP | H09160466 | A | 6/1997 |
| JP | H09222783 | A | 8/1997 |
| JP | 2551714 | Y2 | 10/1997 |
| JP | H09-258634 | A | 10/1997 |
| JP | H10-301382 | A | 11/1998 |
| JP | H11-37169 | A | 2/1999 |
| JP | H11-52716 | A | 2/1999 |
| JP | 2000338760 | A | 12/2000 |
| JP | 2001-042585 | A | 2/2001 |
| JP | 2001-166648 | A | 6/2001 |
| JP | 3266779 | B2 | 3/2002 |
| JP | 2002-169449 | A | 6/2002 |
| JP | 2003-271039 | A | 9/2003 |
| JP | 2003295614 | A | 10/2003 |
| JP | 2003-337504 | A | 11/2003 |
| JP | 2004-045603 | B2 | 2/2004 |
| JP | 2005-241942 | A | 9/2005 |
| JP | 3710375 | B2 | 10/2005 |
| JP | 2006-235236 | A | 9/2006 |
| JP | 2006-243072 | A | 9/2006 |
| JP | 2006-267994 | A | 10/2006 |
| JP | 2007-079284 | A | 3/2007 |
| JP | 2007-164095 | A | 6/2007 |
| JP | 2007-199514 | A | 8/2007 |
| JP | 2008-089731 | A | 4/2008 |
| JP | 2008-216391 | A | 9/2008 |
| JP | 2008-216392 | A | 9/2008 |
| JP | 2008-216393 | A | 9/2008 |
| JP | 2008-216394 | A | 9/2008 |
| JP | 2008216919 | A | 9/2008 |
| JP | 2008299123 | A | 12/2008 |
| JP | 2008299124 | A | 12/2008 |
| JP | 2008299125 | A | 12/2008 |
| JP | 2009069177 | A | 4/2009 |
| JP | 2009-162915 | A | 7/2009 |
| JP | 2009-180983 | A | 8/2009 |
| JP | 4310703 | B2 | 8/2009 |
| JP | 2009-223017 | A | 10/2009 |
| JP | 2009-244560 | A | 10/2009 |
| JP | 2009244563 | A | 10/2009 |
| JP | 2009-276727 | A | 11/2009 |
| JP | 4372703 | B2 | 11/2009 |
| JP | 2009-282099 | A | 12/2009 |
| JP | 2009-288549 | A | 12/2009 |
| JP | 4376861 | B2 | 12/2009 |
| JP | 2011-013323 | A | 1/2011 |
| JP | 3167011 | U | 3/2011 |
| JP | 2011-215374 | A | 10/2011 |
| JP | 4859139 | B2 | 1/2012 |
| JP | 2012-053095 | A | 3/2012 |
| JP | 2012-108537 | A | 6/2012 |
| JP | 2012-194318 | A | 10/2012 |
| JP | 2012-212086 | A | 11/2012 |
| JP | 2012-233941 | A | 11/2012 |
| JP | 2013-011911 | A | 1/2013 |
| JP | 2013501253 | A | 1/2013 |
| JP | 2013054063 | A | 3/2013 |
| RU | 2011138921 | A | 9/2013 |
| WO | 2007062588 | A1 | 6/2007 |
| WO | 2011/015051 | A1 | 2/2011 |
| WO | 2013040989 | A1 | 3/2013 |
| WO | 2013073134 | A1 | 5/2013 |

OTHER PUBLICATIONS

Dec. 11, 2012—(CN) Notification of the First Office Action with Search Report—App 201110251898.6.
Jan. 5, 2012—(JP) Decision of Patent Grant—App 2010-083408.
Jun. 26, 2012—(JP) Notice of Reasons for Rejection—App 2010-193204.
Sep. 18, 2012—(JP) Decision to Grant a Patent—App 2010-193204.
Feb. 19, 2013—(JP) Notice of Reasons for Rejection—App 2012-229560.
Oct. 16, 2013—(US) Notice of Allowance—U.S. Appl. No. 13/222,096.
Oct. 15, 2013—(CN) Office Action—App 201110251898.6.
Apr. 14, 2013—(US) Non-Final Office Action—U.S. Appl. No. 13/628,492.
Dec. 31, 2014—(CN) Notification of First Office Action—App 201310175410.5, Eng Tran.
Feb. 10, 2014—(US) Notice of Allowance—U.S. Appl. No. 14/154,521.
Feb. 27, 2014—(KR) Notice of Preliminary Rejection—App 10-2012-7028457.
Nov. 12, 2014—(US) Non-Final Office Action—U.S. Appl. No. 14/485,462.
Sep. 19, 2014—(US) Notice of Allowance—U.S. Appl. No. 14/275,251.
Sep. 23, 2014—(US) Notice of Allowance—U.S. Appl. No. 13/628,492.
Apr. 6, 2015—(US) Non-Final Office Action—U.S. Appl. No. 14/316,959.
Apr. 15, 2015—(US) Notice of Allowance—U.S. Appl. No. 14/529,221.
Apr. 21, 2015—(EP) Extended Search Report—App 14173865.8.
Aug. 4, 2015—(US) Notice of Allowance—U.S. Appl. No. 14/577,396.
Aug. 20, 2015—(EP) Extended EP Search Report in App No. 15161221.5.
Aug. 21, 2015—(EP) Extended Search Report—App 15161258.7.
Aug. 25, 2015—(US) Non-Final Office Action—U.S. Appl. No. 14/671,413.
Jul. 22, 2015—(US) Non-Final Office Action—U.S. Appl. No. 14/316,971.
Mar. 3, 2015—(CN) Notification of First Office Action—App 201310175229.4, Eng Tran.
Mar. 3, 2015—(CN) Notification of First Office Action—App 201310175264.6, Eng Tran.

(56) References Cited

OTHER PUBLICATIONS

Mar. 19, 2015—(US) Non-Final Office Action—U.S. Appl. No. 14/577,396.
Mar. 20, 2015—(US) Final Office Action—U.S. Appl. No. 14/485,462.
Mar. 27, 2015—Co-pending U.S. Appl. No. 14/670,502.
Mar. 27, 2015—Co-pending U.S. Appl. No. 14/670,676.
May 8, 2015—(US) Ex Parte Quayle—U.S. Appl. No. 14/316,971.
May 18, 2015—(US) Non-Final Office Action—U.S. Appl. No. 14/611,393.
Oct. 5, 2015—(US) Non-Final Office Action—U.S. Appl. No. 14/670,801.
Sep. 16, 2015—(US) Notice of Allowance—U.S. Appl. No. 14/485,462.
Sep. 17, 2015—(EP) Office Action—App 11179283.4.
Sep. 17, 2015—(EP) Office Action—App 11160291.8.
Sep. 17, 2015—(US) Non-Final Office Action—U.S. Appl. No. 14/670,489.
Sep. 23, 2015—(US) Notice of Allowance—U.S. Appl. No. 14/529,221.
Sep. 30, 2015—(US) Non-Final Office Action—U.S. Appl. No. 14/670,522.
Co-pending U.S. Appl. No. 14/316,959, filed Jun. 27, 2014.
Co-pending U.S. Appl. No. 14/316,971, filed Jun. 27, 2014.
Machine translation of JP 07-281519A dated May 2, 2013.
Machine translation of JP 10-031382A dated May 1, 2013.
Machine translation of JP 2006-235236 dated Jan. 9, 2014.
Oct. 19, 2015—(US) Non-Final Office Action—U.S. Appl. No. 14/611,393.
Oct. 28, 2015—(US) Notice of Allowance—U.S. Appl. No. 14/316,959.
Nov. 27, 2015—(US) Non-Final Office Action—U.S. Appl. No. 14/670,502.
Dec. 14, 2015—(US) Non-Final Office Action—U.S. Appl. No. 14/926,345.
Dec. 17, 2015—(US) Non-Final Office Action—U.S. Appl. No. 14/670,676.
Jan. 20, 2016—(US) Notice of Allowance—U.S. Appl. No. 14/316,971.
Jan. 21, 2016—(US) Notice of Allowance—U.S. Appl. No. 14/485,462.
Sep. 16, 2013—(US) Non-final office action—U.S. Appl. No. 13/431,077.
Sep. 6, 2013—(CN) Office Action—App 201210083604.8.
Mar. 27, 2014—(US) Notice of Allowance—U.S. Appl. No. 13/431,077.
May 1, 2015—(US) Non-Final Office Action—U.S. Appl. No. 14/491,157.
Dec. 24, 2015—(US) Notice of Allowance—U.S. Appl. No. 14/491,157.
Sep. 30, 2013—(CN) Office Action—App 201210083716.3.
Nov. 19, 2013—(JP) Office Action—App 2013-103770.
Jan. 8, 2014—(US) Notice of Allowance—U.S. Appl. No. 13/430,950.
May 27, 2014—(EP) Extended Search Report—App 12161226.1.
Feb. 4, 2015—(US) Notice of Allowance—U.S. Appl. No. 14/289,780.
Jan. 20, 2015—(JP) Notification of Reasons for Refusal—App 2014-042421, Eng Tran.
Jul. 16, 2012—(EP) Search Report—App 12157690.4.
Feb. 19, 2014—(US) Notice of Allowance—U.S. Appl. No. 13/431,074.
Jun. 19, 2014—(US) Non-final office action—U.S. Appl. No. 14/290,188.
Oct. 7, 2014—(US) Notice of Allowance—U.S. Appl. No. 14/290,188.
Apr. 14, 2016—(US) Notice of Allowance—U.S. Appl. No. 14/670,522.
Feb. 8, 2016—(EP) Extended European Search Report—App 15161221.5.
Sep. 23, 2015—(EP) Extended European Search Report—App 15161223.1.
Sep. 23, 2015—(EP) Extended European Search Report—App 15161224.9.
Sep. 25, 2015—(EP) Extended European Search Report—App 15161229.8.
Sep. 29, 2015—(EP) Extended European Search Report—App 15161242.1.
Apr. 26, 2016—(US) Non-Final Office Action—U.S. Appl. No. 15/079,829.
May 9, 2016—(US) Notice of Allowance—U.S. Appl. No. 14/670,489.
May 24, 2016—(US) Notice of Allowance—U.S. Appl. No. 14/485,462.
May 27, 2016—(US) Notice of Allowance—U.S. Appl. No. 14/671,413.
Jun. 10, 2016—(US) Notice of Allowance—U.S. Appl. No. 14/316,971.
Jun. 17, 2016—(US) Notice of Allowance—U.S. Appl. No. 14/926,345.
Jun. 17, 2016—(US) Notice of Allowance—U.S. Appl. No. 14/491,157.
Jun. 22, 2016—(US) Notice of Allowance—U.S. Appl. No. 14/670,516.
May 24, 2016—(EP) Communication—App 12157679.7.
Sep. 14, 2015—(EP) Communication—App 12157679.7.
May 24, 2016—(EP) Communication—App 12157690.4.
Sep. 11, 2015—(EP) Communication—App 12157690.4.
Jul. 16, 2012—(EP) Search Report 12157679.7.
Jun. 22, 2016—(US) Notice of Allowance—U.S. Appl. No. 14/529,221.
Apr. 16, 2016 (JP) Notice of Allowance—App. 2011100507.
Feb. 17, 2015 (JP) Notice of Allowance—App. 2011078637.
May 11, 2016—(EP) Communication—App 12161226.1.
Jun. 29, 2016—(US) Notice of Allowance—U.S. Appl. No. 14/611,393.
Jul. 1, 2016—(US) Notice of Allowance—U.S. Appl. No. 14/670,801.
Jul. 11, 2016 (US) Non-Final Office Action—U.S. Appl. No. 14/670,502.
Jul. 14, 2016—(US) Notice of Allowance—U.S. Appl. No. 14/670,676.
Jul. 18, 2016—(US) Notice of Allowance—U.S. Appl. No. 14/316,971.
Jul. 15, 2016—(US) Notice of Allowance—U.S. Appl. No. 14/670,522.
Jul. 18, 2016—(US) Notice of Allowance—U.S. Appl. No. 14/670,489.
Jul. 21, 2016—(US) Notice of Allowance—U.S. Appl. No. 14/671,413.
Jul. 26, 2016—(US) Notice of Allowance—U.S. Appl. No. 14/296,345.
Jul. 29, 2016—(US) Notice of Allowance—U.S. Appl. No. 14/491,157.
Aug. 1, 2016—(US) Notice of Allowance—U.S. Appl. No. 14/485,462.
Aug. 1, 2016—(US) Notice of Allowance—U.S. Appl. No. 14/670,516.
Feb. 2, 2016—(US) Notice of Allowance—U.S. Appl. No. 14/670,516.
Feb. 17, 2016—(US) Notice of Allowance—U.S. Appl. No. 14/671,413.
Feb. 18, 2016—(US) Notice of Allowance—U.S. Appl. No. 14/529,221.
Feb. 25, 2016—(US) Non-Final Office Action—U.S. Appl. No. 14/316,959.
Mar. 4, 2016—(US) Notice of Allowance—U.S. Appl. No. 14/491,157.
Mar. 29, 2016—(US) Notice of Allowance—U.S. Appl. No. 14/485,462.
Apr. 1, 2016—(US) Notice of Allowance—U.S. Appl. No. 14/926,345.

(56) References Cited

OTHER PUBLICATIONS

Apr. 12, 2016—(US) Notice of Allowance—U.S. Appl. No. 14/611,393.
Feb. 25, 2016—(US) Office Action—U.S. Appl. No. 14/316,959.
Aug. 8, 2016—(US) Notice of Allowance—U.S. Appl. No. 14/671,413.
Aug. 9, 2016—(US) Notice of Allowance—U.S. Appl. No. 15/079,829.
Aug. 10, 2016—(US) Notice of Allowance—U.S. Appl. No. 14/316,971.
Aug. 12, 2016—(US) Notice of Allowance—U.S. Appl. No. 14/670,489.
Aug. 15, 2016—(US) Notice of Allowance—U.S. Appl. No. 14/670,676.
Aug. 17, 2016—(US) Notice of Allowance—U.S. Appl. No. 14/670,522.
Sep. 14, 2016—(US) Notice of Allowance—U.S. Appl. No. 14/316,959.
Sep. 19, 2016—(US) Notice of Allowance—U.S. Appl. No. 14/611,393.
Sep. 21, 2016—(US) Notice of Allowance—U.S. Appl. No. 14/529,221.
Sep. 28, 2016—(US) Notice of Allowance—U.S. Appl. No. 14/670,801.
Dec. 1, 2016—(US) Non-Final Office Action—U.S. Appl. No. 14/316,959.
Nov. 22, 2016—(JP) Office Action—App 2013137422—Eng Tran.
Dec. 6, 2016—(US) Notice of Allowance and Fees Due—U.S. Appl. No. 14/611,393.
Dec. 13, 2016—(JP) Office Action—App 2014000609—Eng Tran.
Dec. 13, 2016—(JP) Office Action—App 2013137425—Eng Tran.
Dec. 12, 2016—(JP) Office Action—App 2014074727—Eng Tran.
Dec. 27, 2016—(JP) Office Action—App 2014074728—Eng Tran.
Dec. 27, 2016—(JP) Office Action—App 2014074729—Eng Tran.
Dec. 27, 2016—(JP) Office Action—App 2014074730—Eng Tran.
Nov. 7, 2016—(US) Notice of Allowance—U.S. Appl. No. 14/670,676.
Nov. 3, 2016—(US) Notice of Allowance—U.S. Appl. No. 14/671,413.
Nov. 10, 2016—(US) Notice of Allowance—U.S. Appl. No. 14/670,516.
Nov. 10, 2016—(US) Notice of Allowance—U.S. Appl. No. 14/485,462.
Nov. 14, 2016—(US) Notice of Allowance—U.S. Appl. No. 14/670,522.
Nov. 15, 2016—(US) Notice of Allowance—U.S. Appl. No. 14/670,489.
Nov. 16, 2016—(US) Notice of Allowance—U.S. Appl. No. 14/316,971.
Nov. 23, 2016—(US) Notice of Allowance—U.S. Appl. No. 14/529,221.
Nov. 28, 2016—(US) Notice of Allowance—U.S. Appl. No. 15/079,829.
Nov. 28, 2016—(US) Notice of Allowance—U.S. Appl. No. 14/670,502.
Nov. 25, 2016—(US) Notice of Allowance—U.S. Appl. No. 14/926,345.
Nov. 30, 2016—(US) Notice of Allowance—U.S. Appl. No. 14/491,157.

* cited by examiner

DEVELOPING CARTRIDGE

CROSS REFERENCE TO RELATED APPLICATION

The present application claims priority from Japanese Patent Application No. 2014-000609 filed on Jan. 6, 2014, the disclosure of which is incorporated herein by reference in its entirety.

BACKGROUND

Field of the Invention

The present invention relates to a developing cartridge configured to be installed to an image forming apparatus adopting an electro-photographic type.

Description of the Related Art

There is conventionally known an image forming apparatus of an electro-photographic type to which a developing cartridge is detachably installed. Such an image forming apparatus is provided with a new or unused cartridge detection means for judging as to whether or not the installed developing cartridge is new.

For example, a laser printer is provided with a developing cartridge and a detecting mechanism, the developing cartridge including a detection objective rotating part and an agitator gear, and the detecting mechanism including an actuator and an optical sensor (photodetector). The detection objective rotating part has a detection objective portion. When the developing cartridge is installed to a body casing in the laser printer, driving force is transmitted to the detection objective rotating part via the agitator gear. The driving force rotates the detection objective rotating part, which causes the detection objective portion to abut against the actuator, and thereby swinging the actuator. Then, the optical sensor detects the swing of the actuator, and the laser printer judges whether or not the developing cartridge is new based on the detection result (for example, see Japanese Patent Application Laid-open No. 2012-108537).

SUMMARY

In the developing cartridge described in Japanese Patent Application Laid-open No. 2012-108537, the detection objective rotating part and the agitator gear are positioned on the outside of a first side wall of the developing cartridge. Those positioned on the outside of the first side wall include an input gear to which the driving force is inputted, a developing gear which meshes with the input gear, a supply gear, and an intermediate gear. Thus, an area in which the above gears are disposed is required to be provided on the outside of the first side wall, which results in a larger developing cartridge. Specifically, the developing cartridge could be larger in a direction orthogonal to the central axis of each of the gears. Further, a gear cover is attached to the first side wall to cover each of the gears therewith. In a case that a joint or an engaging portion, which protrudes in a direction along the central axis of each of the gears, is formed in an inner surface of the gear cover, and that the agitator gear is engaged with the engaging portion so that the agitator gear is rotatably retained, it is necessary to secure an area, in which the engaging portion is disposed, on the inside of the gear cover. Therefore, the developing cartridge could be even larger in the direction orthogonal to the central axis of each of the gears.

In view of the above, an object of the present invention is to provide a downsized developing cartridge which can be detected appropriately whether or not the developing cartridge is new or unused.

According to a first aspect of the present teaching, there is provided a developing cartridge, including: an agitation member configured to be rotatable around a rotational shaft extending in a first direction and to agitate a developer; an agitation gear including a first gear and a second gear and fixed to the agitation member, the first gear being configured to receive driving force to be inputted and to transmit the driving force to the second gear, and the second gear being positioned on one side of the first gear in the first direction; a detection target unit including a detection target receiving portion configured to receive the driving force from the second gear and a detection target portion configured to be detected by an external detecting apparatus; and a gear cover configured to cover at least a part of the agitation gear and the detection target unit therewith, wherein the detection target portion is configured to move between the second gear and the gear cover when being projected in a direction orthogonal to the first direction.

According to this configuration, the detection target unit includes the detection target portion. Thus, whether or not the developing cartridge is new or unused can be detected appropriately through detection of the detection target portion.

The detection target portion moves between the second gear and the gear cover when being projected in the direction orthogonal to the first direction. Thus, a space between the second gear and the gear cover can be utilized effectively, which enables the downsizing of the developing cartridge.

According to a second aspect of the present teaching, there is provided a developing cartridge including: a housing including a first wall and a second wall and being configured to contain a developer therein, the second wall being separated from the first wall in a first direction; a coupling configured to receive driving force from an outside and to rotate around a first rotational axis along the first direction; an agitation member including a rotational shaft which extends in the first direction and being configured to agitate the developer in the housing; an agitation gear including a first gear and a second gear which are arranged in the first direction and being configured to be supported by the rotational shaft of the agitation member to transmit the driving force to the agitation member; a driving transmission gear including a third gear and a fourth gear which are arranged in the first direction and being configured to rotate around a second rotational axis along the first direction to transmit the driving force from the coupling to the agitation gear, the third gear being configured to mesh with the first gear, and the fourth gear being configured to mesh with the coupling; a detection target unit including a detection target receiving portion and a detection target portion and being configured to rotate around a third rotational axis along the first direction, the detection target receiving portion being configured to receive the driving force from the second gear, and the detection target portion being configured to be detected by an external detecting apparatus; and a gear cover configured to cover at least a part of the detection target unit, the agitation gear, and the driving transmission gear therewith, wherein the fourth gear overlaps with the second gear when being projected in the first direction, and the detection target portion is configured to move between the second gear and the gear cover when being projected in a direction orthogonal to the first direction.

According to this configuration, the detection target unit includes the detection target portion. Thus, whether or not the developing cartridge is new or unused can be detected appropriately through detection of the detection target portion.

The detection target portion moves between the second gear and the gear cover when being projected in the direction orthogonal to the first direction. Thus, a space between the second gear and the gear cover can be utilized effectively, which enables the downsizing of the developing cartridge.

The fourth gear overlaps with the second gear when being projected in the first direction. Thus, the fourth gear can be positioned while a space provided at the outside of the second gear in the first direction is utilized effectively. As a result, the driving transmission gear and the agitation gear can be positioned closely to each other in the direction orthogonal to the first direction.

Regarding the downsized developing cartridge of the present teaching, whether or not the developing cartridge is new or unused can be appropriately detected.

BRIEF DESCRIPTION OF THE DRAWINGS

FIG. 9B depicts the state in which the first gear of the agitator gear meshes with the detection gear portion of the detection gear.

FIG. 10 depicts the state in which the detection gear is positioned at the end position.

DESCRIPTION OF THE PREFERRED EMBODIMENTS

1. Outline of Developing Cartridge

Figure 1:
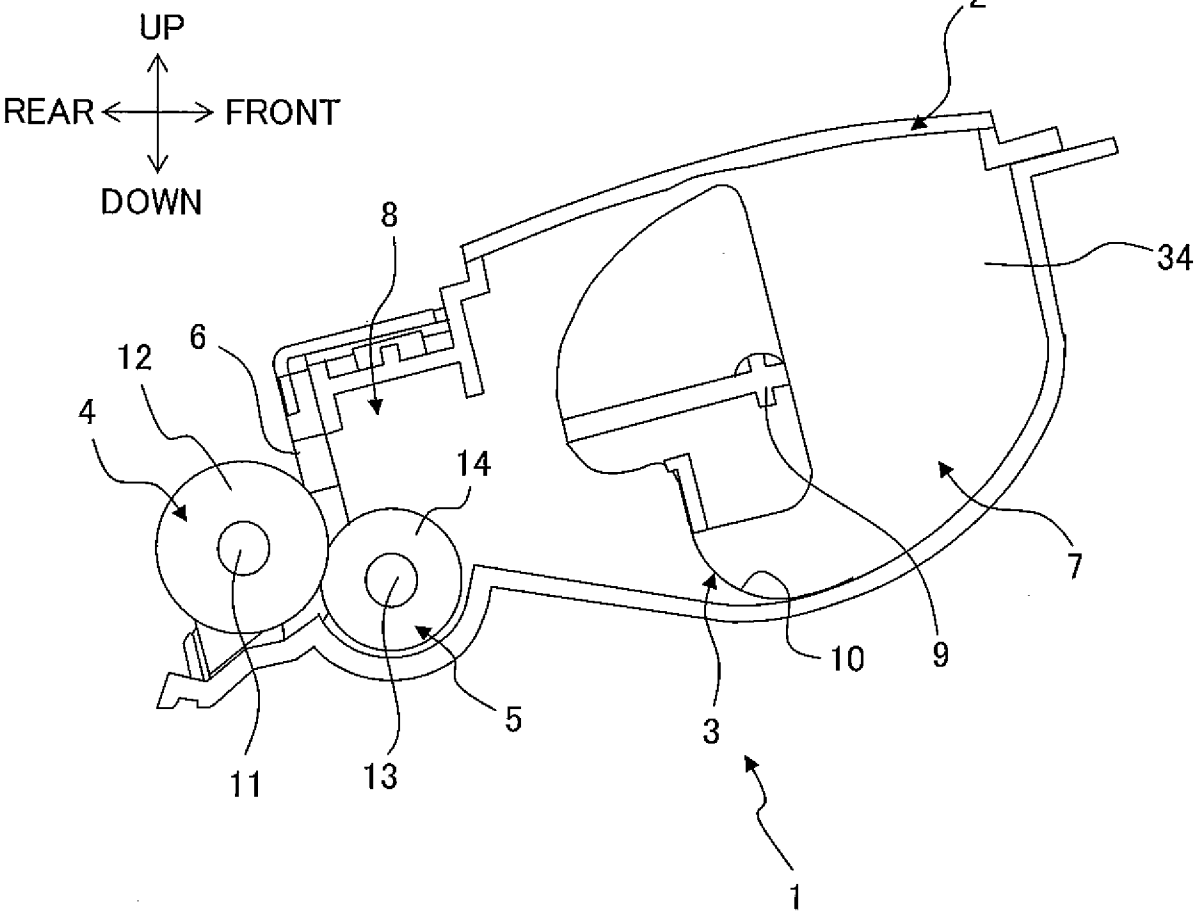
FIG. 1 is a central sectional view of a developing cartridge as an embodiment of the present teaching.

As depicted in FIG. 1, a developing cartridge 1 is provided with a housing 2, an agitator 3 as an exemplary agitation member, a developing roller 4, a supply roller 5, and a layer-thickness regulating blade 6.

In the following description, in a case that the direction concerning the developing cartridge 1 is mentioned, the side at which the developing roller 4 is positioned is defined as the rear side of the developing cartridge 1, and the side opposite to the side at which the developing roller 4 is positioned is defined as the front side of the developing cartridge 1. The left-right direction of the developing cartridge 1 is defined based on the direction when the developing cartridge 1 is viewed from the front side. Specifically, the respective directions of the developing cartridge 1 are depicted by arrows in the drawings. That is, when the sheet surface of FIG. 1 is placed in a portrait direction, the upper side of FIG. 1 is defined as the upper side of the developing cartridge 1; the lower side of FIG. 1 is defined as the lower side of the developing cartridge 1; the left side of FIG. 1 is defined as the rear side of the developing cartridge 1; the right side of FIG. 1 is defined as the front side of the developing cartridge 1; the near side of the sheet surface is defined as the left side of the developing cartridge 1; and the back or far side of the sheet surface is defined as the right side of the developing cartridge 1. The left-right direction is an exemplary first direction, the front-rear direction is an exemplary second direction, and the up-down direction is an exemplary third direction.

The housing 2 has a substantially boxed shape extending in the left-right direction, and the rear end of the housing 2 is open in the front-rear direction. Further, the housing 2 includes therein a toner accommodating chamber 7 and a developing chamber 8 which are adjacent to each other in the front-rear direction. The toner accommodating chamber 7 is positioned on the front side of the developing chamber 8. The toner accommodating chamber 7 contains toner as an exemplary developer.

The agitator 3 is positioned roughly in the center of the toner accommodating chamber 7 in the front-rear direction and the up-down direction. The agitator 3 is provided with an agitator shaft 9 as an exemplary rotational shaft and an agitation blade 10. The agitator shaft 9 has a substantially cylindrical shape extending in the left-right direction. The agitation blade 10 extends outward in a radial direction of the agitator shaft 9 from the agitator shaft 9. The agitator 3 is configured to rotate by allowing both ends of the agitator shaft 9 in the left-right direction to be rotatably supported by the housing 2.

The developing roller 4 is positioned at the rear end of the developing chamber 8. The developing roller 4 is provided with a developing roller shaft 11 and a rubber roller 12. The developing roller shaft 11 has a substantially cylindrical shape extending in the left-right direction. The rubber roller 12 covers the developing roller shaft 11 therewith so that both ends of the developing roller shaft 11 in the left-right direction are exposed. The developing roller 4 is configured to rotate by allowing both ends of the developing roller shaft 11 in the left-right direction to be rotatably supported by the housing 2. The upper part and the rear part of the developing roller 4 are exposed from the housing 2.

The supply roller 5 is positioned in the developing chamber 8 at a lower-front side of the developing roller 4. The supply roller 5 is provided with a supply roller shaft 13 and a sponge roller 14. The supply roller shaft 13 has a substantially cylindrical shape extending in the left-right direction. The sponge roller 14 covers the supply roller shaft 13 therewith so that both ends of the supply roller shaft 13 in the left-right direction are exposed. The supply roller 5 is configured to rotate by allowing both ends of the supply roller shaft 13 in the left-right direction to be rotatably supported by the housing 2. The upper-rear end of the supply roller 5 is brought in contact under pressure with the lower-front end of the developing roller 4.

The layer-thickness regulating blade 6 is positioned in the developing chamber 8 at the upper-front side of the developing roller 4. The layer-thickness regulating blade 6 has a substantially rectangular plate shape extending in the left-right direction as viewed from the back side, and the layer-thickness regulating blade 6 extends in the up-down direction in side view. The layer-thickness regulating blade 6 is supported by the housing 2 so that the lower end of the layer-thickness regulating blade 6 makes contact with the upper-front end of the developing roller 4.

2. Embodiment of Use of Developing Cartridge

Figure 2:
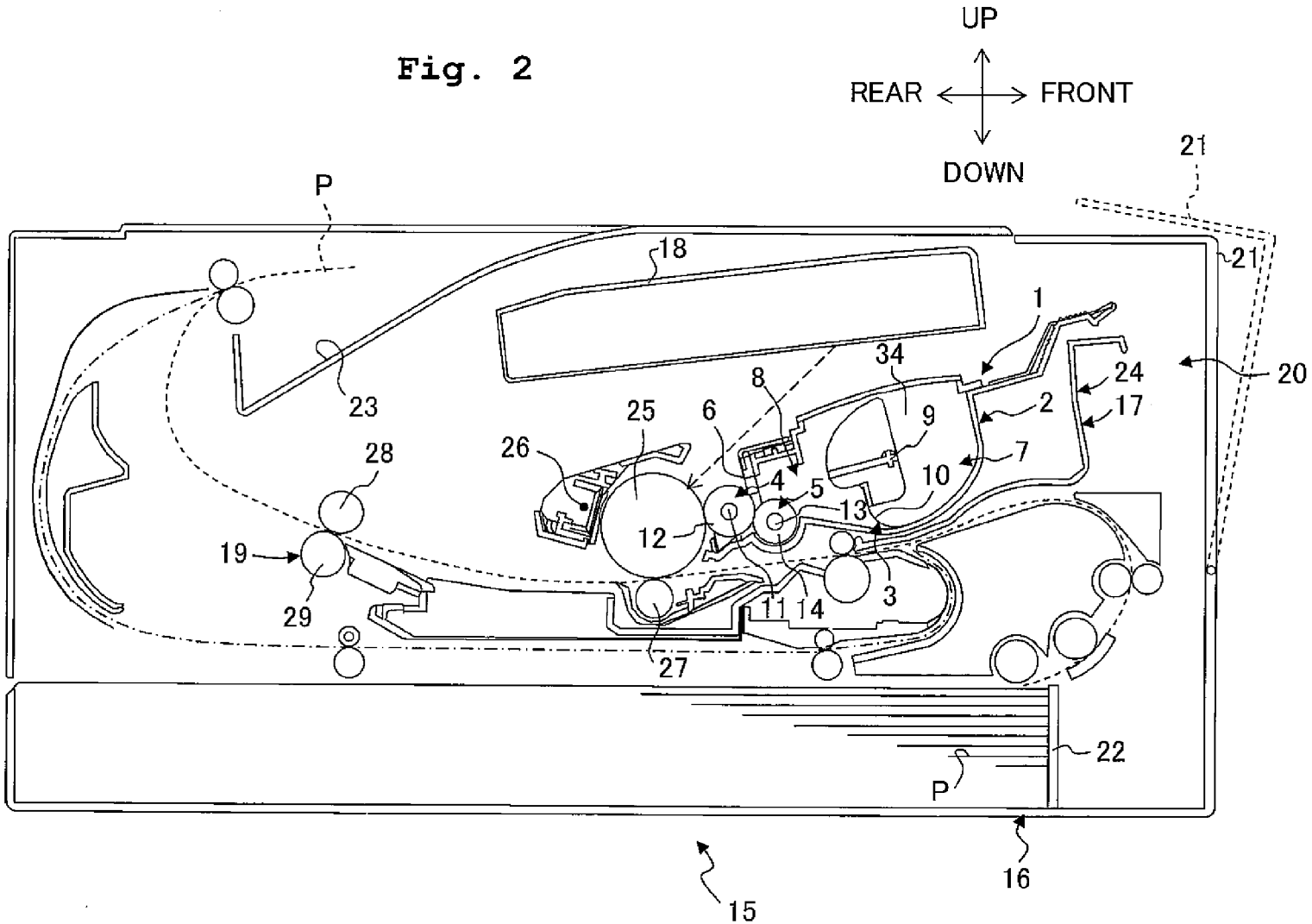
FIG. 2 is a central sectional view of a printer including the developing cartridge depicted in FIG. 1.

As depicted in FIG. 2, the developing cartridge 1 is equipped for a printer 15. The printer 15 is a monochrome printer or a black and white printer of the electro-photographic type. The printer 15 is provided with a body casing 16, a process cartridge 17, a scanner unit 18, and a fixing unit 19.

The body casing 16 has a substantially box shape. The body casing 16 has an opening 20, a front cover 21, a feed tray 22, and a discharge tray 23.

The opening 20 penetrates a front wall of the body casing 16 in the front-rear direction. The opening 20 is configured to allow the process cartridge 17 to pass therethrough.

The front cover 21 has a substantially L-shaped plate form in side view. The front cover 21 is swingably supported by the front wall of the body casing 16 by using the lower end of the front cover 21 as the fulcrum. The front cover 21 is configured to open or close the opening 20.

The feed tray 22 is positioned at the bottom of the body casing 16. The feed tray 22 is configured to accommodate or load sheets P.

The discharge tray 23 is positioned on the upper surface of the body casing 16.

The process cartridge 17 is configured to be installed to or removed from the body casing 16 via the opening 20. The process cartridge 17 is provided with a drum cartridge 24 and the developing cartridge 1.

The drum cartridge 24 is provided with a photosensitive drum 25, a scorotron type charging unit 26, and a transfer roller 27.

The photosensitive drum 25 is positioned at the rear end of the drum cartridge 24, and has a substantially cylindrical shape in the left-right direction. The photosensitive drum 25 is rotatably supported by a frame of the drum cartridge 24.

The scorotron type charging unit 26 is positioned on the rear side of the photosensitive drum 25 with a spacing distance intervening therebetween.

The transfer roller 27 is positioned on the lower side of the photosensitive drum 25. The transfer roller 27 makes contact with the lower end of the photosensitive drum 25.

The developing cartridge 1 is configured to be installed to or removed from the drum cartridge 24. The rear end of the developing roller 4 is brought into contact with the front end of the photosensitive drum 25 in a state that the developing cartridge 1 is installed to the drum cartridge 24.

The scanner unit 18 is positioned over or above the process cartridge 17. The scanner unit 18 is configured to emit or output a laser beam toward the photosensitive drum 25 based on image data as depicted by the dotted line in FIG. 2.

The fixing unit 19 is positioned on the rear side of the process cartridge 17. The fixing unit 19 is provided with a heating roller 28 and a pressing roller 29. The pressing roller 29 is positioned on the lower-rear side of the heating roller 28, and the pressing roller 29 is brought into contact under pressure with the lower-rear end of the heating roller 28.

In a case that an image forming operation is started in accordance with the control of an unillustrated control unit in the printer 15, the scorotron type charging unit 26 uniformly charges or electrifies the surface of the photosensitive drum 25. After that, the scanner unit 18 exposes the surface of the photosensitive drum 25 based on the image data. Accordingly, an electrostatic latent image based on the image data is formed on the surface of the photosensitive drum 25.

The agitator 3 agitates the toner in the toner accommodating chamber 7, and supplies the agitated toner to the supply roller 5. The supply roller 5 conveys the toner supplied from the agitator 3 to the developing roller 4. In this situation, the toner is frictionally charged between the developing roller 4 and the supply roller 5 to have a positive charge and the toner is carried on the developing roller 4. The layer-thickness regulating blade 6 regulates the toner carried on the developing roller 4 to have a certain thickness.

The toner carried on the developing roller 4 and having the certain thickness is supplied to the electrostatic latent image, which is formed on the surface of the photosensitive drum 25, by the developing roller 4. Accordingly, the toner image is carried on the surface of the photosensitive drum 25.

The sheet P is fed or sent between the photosensitive drum 25 and the transfer roller 27 from the feed tray 22 at a predetermined timing one by one due to rotation of various rollers. The toner image on the photosensitive drum 25 is transferred onto the sheet P when the sheet P passes between the photosensitive drum 25 and the transfer roller 27.

After that, the sheet P is heated and pressed when passing between the heating roller 28 and the pressing roller 29. This thermally fixes, onto the sheet P, the toner image transferred on the sheet P. Then, the sheet P is discharged to the discharge tray 23.

3. Details of Developing Cartridge

Figure 3:
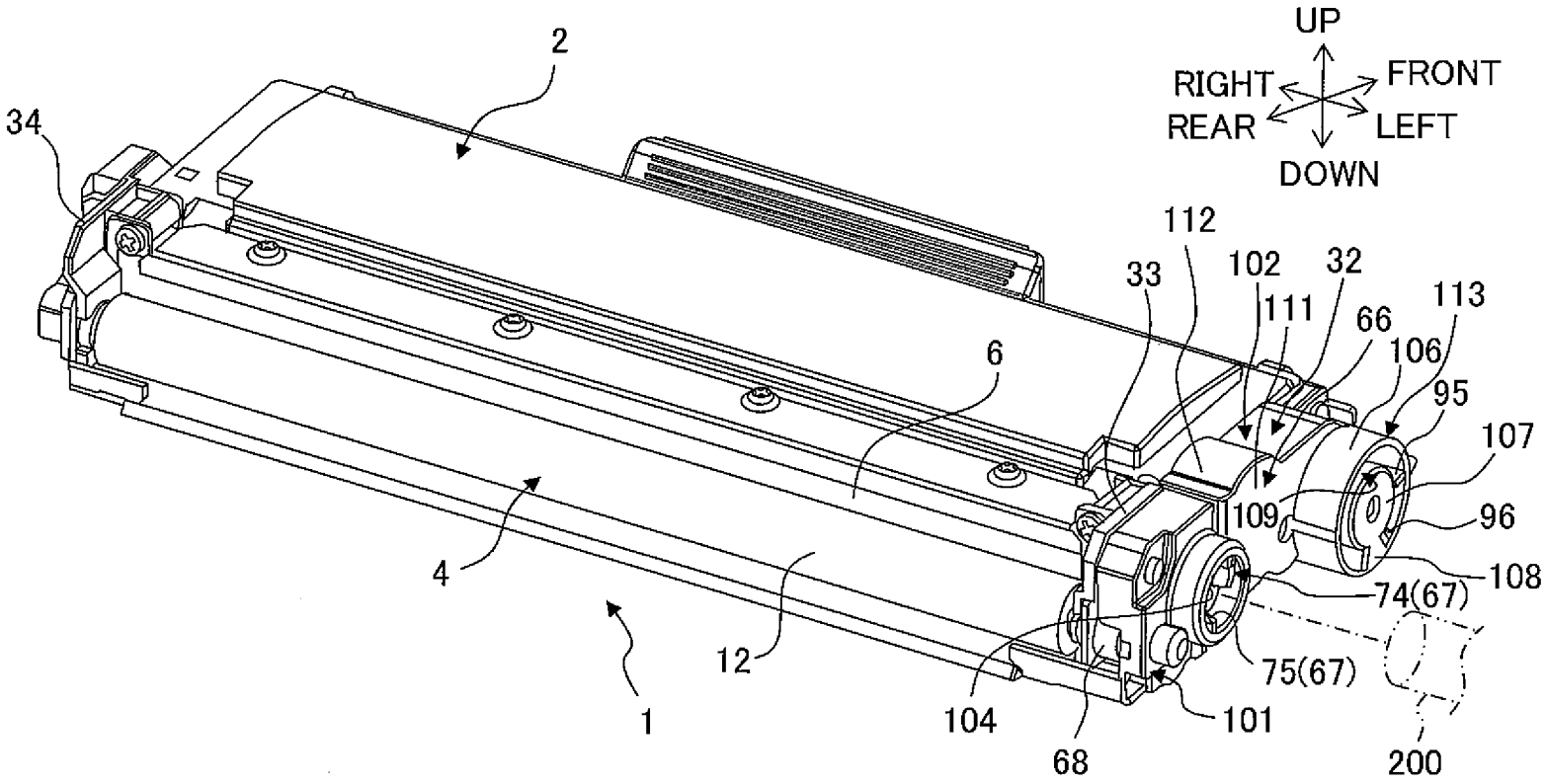
FIG. 3 is a perspective view of the developing cartridge depicted in FIG. 1 as viewed from the upper left side.

As depicted in FIG. 3, the developing cartridge 1 is provided with a driving unit 32 disposed on the left side of the housing 2.

<Housing>

The housing 2 includes a left side wall 33 as an exemplary first wall and a right side wall 34 as an exemplary second wall. The left side wall 33 is separated from the right side wall 34 in the left-right direction. Each of the left side wall 33 and the right side wall 34 has a substantially rectangular plate shape extending in the front-rear direction in side view.

Figure 4:
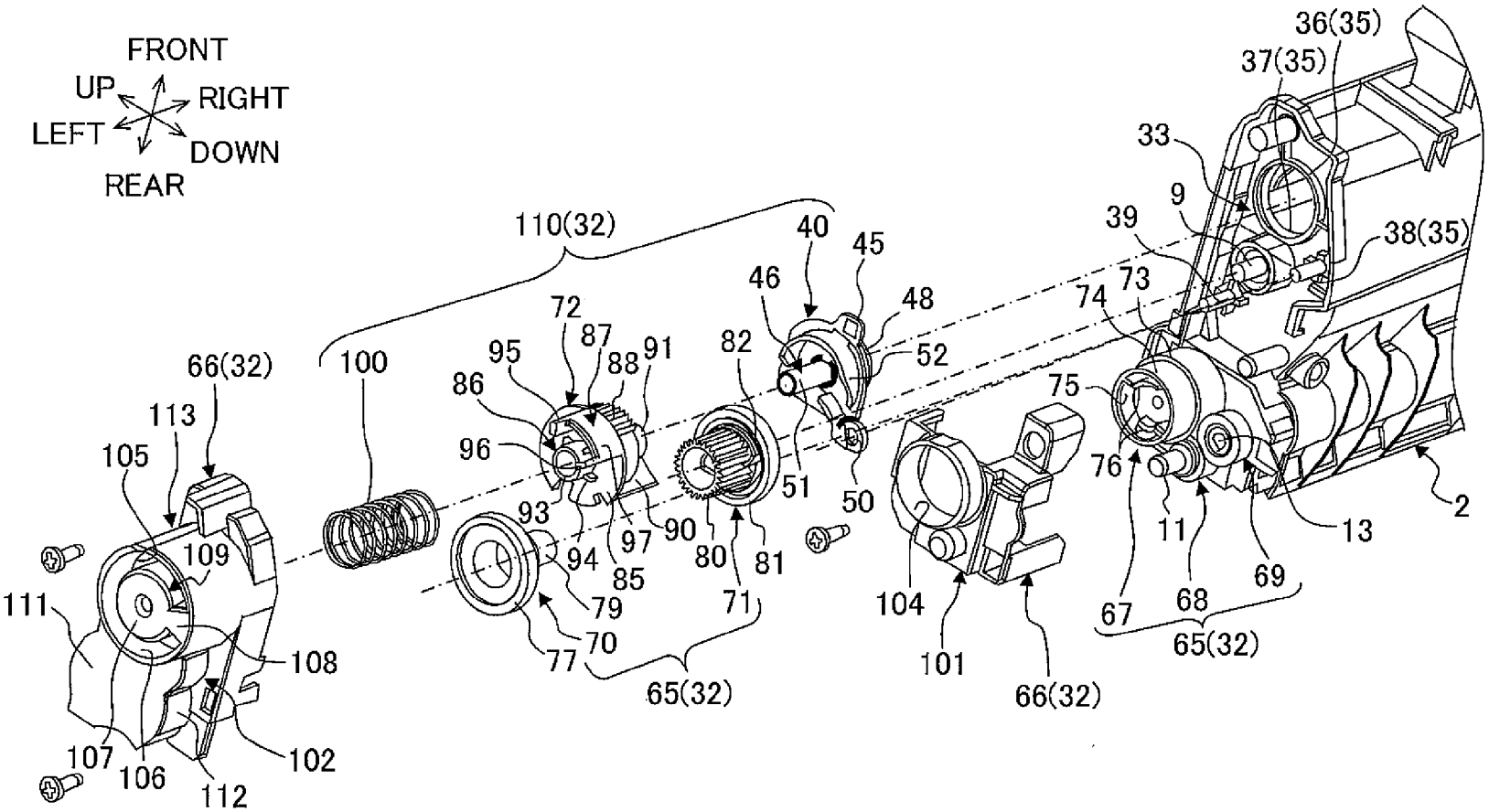
FIG. 4 is an exploded perspective view of a detection unit depicted in FIG. 3 as viewed from the lower left side.

As depicted in FIG. 4, those protruding leftward from the left side wall 33 include the left end of the agitator shaft 9 of the agitator 3, the left end of the developing roller shaft 11 of the developing roller 4, and the left end of the supply roller shaft 13 of the supply roller 5. The left side wall 33 is provided with an idle gear support shaft 39 and a cap support portion 35.

The idle gear support shaft 39 is positioned roughly in the center of the left surface of the left side wall 33 in the front-rear direction and is positioned at the upper-rear side of the left end of the agitator shaft 9 protruding from the left side wall 33. The idle gear support shaft 39 has a substantially cylindrical shape extending in the left-right direction, and protrudes leftward from the left surface of the left side wall 33.

The cap support portion 35 is positioned at the front end of the left side wall 33. The cap support portion 35 is provided with a toner filling port 37, a protruding portion 36, and a positioning portion 38.

The toner filing port 37 has a substantially circular shape in side view. The toner filing port 37 penetrates the front end of the left side wall 33 in the left-right direction, so that a space inside the toner accommodating chamber 7 communicates with a space outside the toner accommodating chamber 7 in the left-right direction.

The protruding portion 36 has a substantially cylindrical shape which protrudes leftward from the periphery of the toner filling port 37. The positioning portion 38 is positioned on the lower-rear side of the protruding portion 36 with a spacing distance intervening therebetween. The positioning portion 38 has a substantially cylindrical shape extending in the left-right direction, and protrudes leftward from the left surface of the left side wall 33. The toner filling port 37 is closed by using a cap 40 which will be described later.

<Driving Unit>

As depicted in FIGS. 3 and 4, the driving unit 32 is disposed on the left side of the left side wall 33, and the driving unit 32 is provided with a gear row 65, a detection unit 110, and a gear cover 66.

<Gear Row>

Figure 6A:
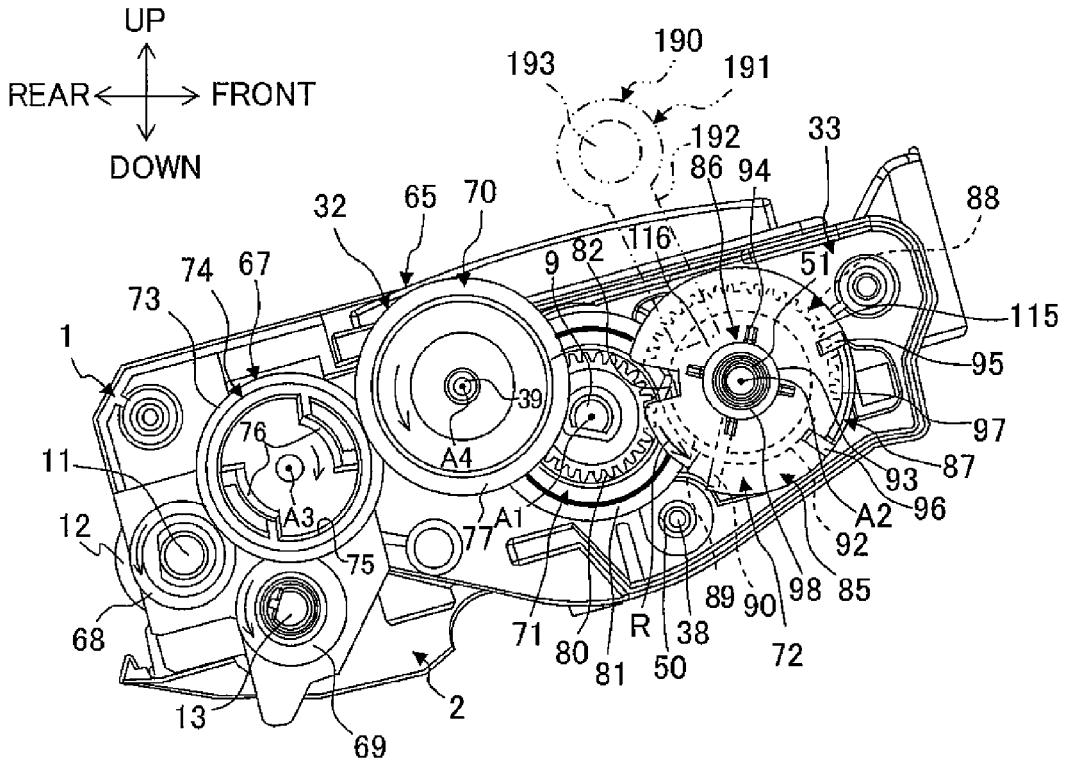
FIG. 6A is an illustrative view illustrating a new cartridge detection operation of the detection unit and depicting a state in which a first engaging portion of an agitator gear abuts against a second engaging portion of the detection gear at an initial position.

As depicted in FIG. 6A, the gear row 65 is provided with a developing coupling 67 as an exemplary coupling, a developing gear 68, a supply gear 69, an idle gear 70 as an exemplary driving transmission gear, and an agitator gear 71 as an exemplary agitator gear.

<Developing Coupling>

The developing coupling 67 is positioned at the rear part of the left surface of the left side wall 33. The developing coupling 67 has a substantially cylindrical shape extending in the left-right direction, and the developing coupling 67 is rotatably supported by the left side wall 33. This allows the developing coupling 67 to rotate about a rotation axis A3 extending in the left-right direction. As depicted in FIG. 4, the developing coupling 67 includes a coupling gear 73 and a coupling portion 74 in an integrated manner.

The coupling gear 73 is positioned at a right part of the developing coupling 67. The coupling gear 73 has a substantially cylindrical shape extending in the left-right direction. The coupling gear 73 has gear teeth along the entire circumference thereof.

The coupling portion 74 is positioned at a left part of the developing coupling 67. The coupling portion 74 has a substantially cylindrical shape extending in the left-right direction. The outer diameter of the coupling portion 74 is smaller than the outer diameter of the coupling gear 73. The coupling gear 74 includes a connection recess 75 and a pair of projections 76.

The connection recess 75 is positioned at a left end surface of the coupling portion 74. The connection recess 75 has a substantially circular form in side view, and is recessed rightward from the left end surface of the coupling portion 74.

Each of the projections 76 is positioned in the connection recess 75. The projections 76 are positioned to face each other in a radial direction of the connection recess 75. Each of the projections 76 protrudes inward in the radial direction, that is, from the inner circumferential surface of the connection recess 75 toward the center of the connection recess 75.

<Developing Gear>

Figure 7A:
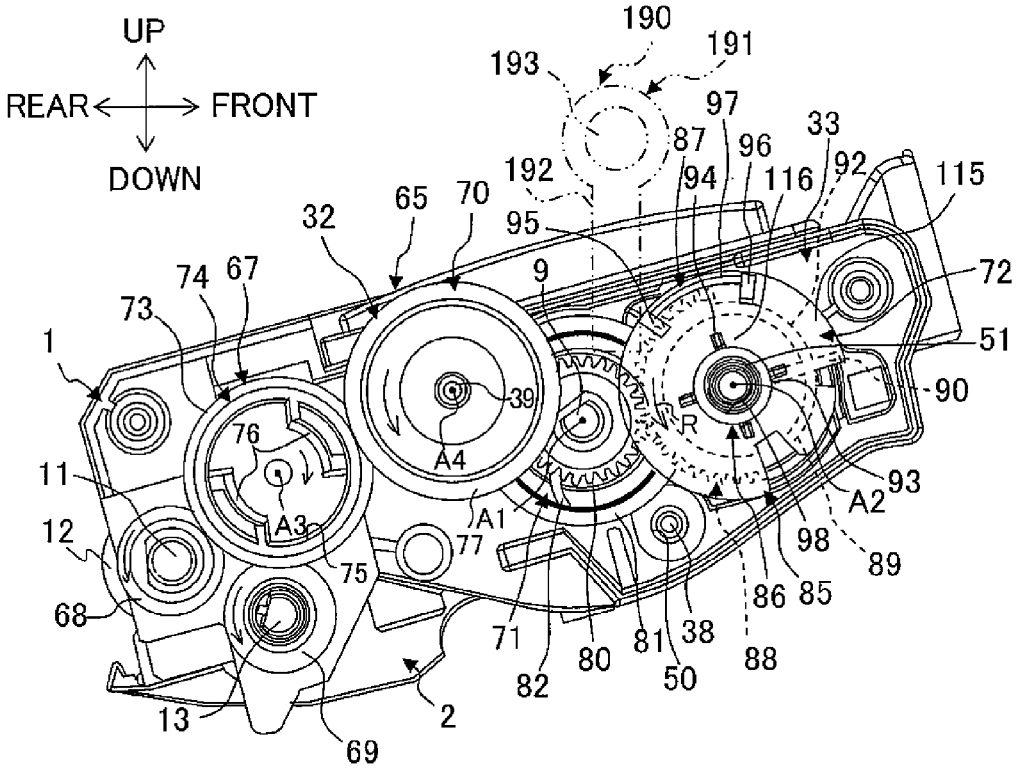
FIG. 7A is still another illustrative view, continued from FIG. 6B, illustrating the new cartridge detection operation of the detection unit and depicting a state in which the detection gear is positioned at an advancing position to cause a first detection projection to abut against the actuator.

As depicted in FIG. 7A, the developing gear 68 is positioned on the lower-rear side of the developing coupling 67. The developing gear 68 has a substantially cylindrical shape extending in the left-right direction. The developing gear 68 has gear teeth along the entire circumference thereof. The developing gear 68 is attached to the left end of the developing roller shaft 11 such that the developing gear 68 cannot rotate relative to the developing roller shaft 11. The upper-front end of the developing gear 68 meshes with the lower-rear end of the coupling gear 73 of the developing coupling 67.

<Supply Gear>

The supply gear 69 is positioned on the lower side of the developing coupling 67. The supply gear 69 has a substantially cylindrical shape extending in the left-right direction. The supply gear 69 has gear teeth along the entire circumference thereof. The supply gear 69 is attached to the left end of the supply roller shaft 13 such that the supply gear 69 cannot rotate relative to the supply roller shaft 13. The upper end of the supply gear 69 meshes with the lower end of the coupling gear 73 of the developing coupling 67.

<Idle Gear>

Figure 9A:
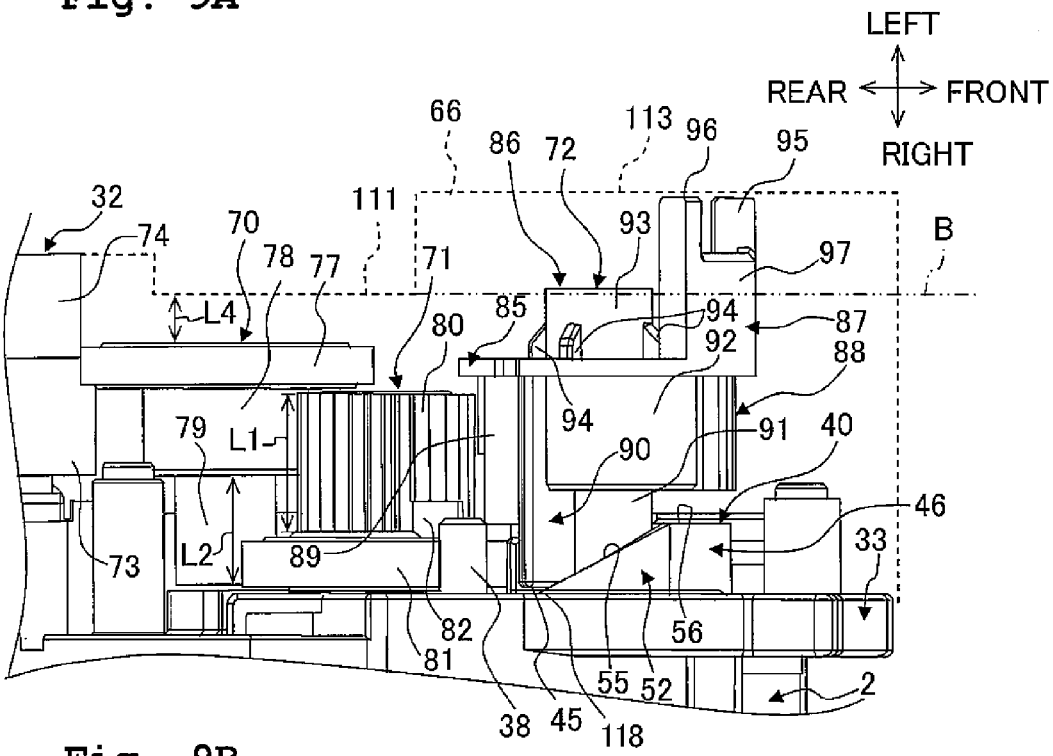
FIG. 9A is a bottom view of a gear row depicted in FIG. 4 as viewed from the lower side and FIG. 9A depicts a state in which the detection gear is positioned at the initial position.

The idle gear 70 is positioned on the front side of the developing coupling 67. The idle gear 70 has a substantially cylindrical shape extending in the left-right direction. As depicted in FIG. 9A, the idle gear 70 includes a large-diameter gear 77 as an exemplary fourth gear, an intermediate portion 78, and a small-diameter gear 79 as an exemplary third gear in an integrated manner.

The large-diameter gear 77 is positioned at the left end of the idle gear 70. The large-diameter gear 77 has a substantially annular shape having a thickness in the left-right direction. The large-diameter gear 77 has gear teeth along the entire circumference thereof. As depicted in FIG. 7A, the rear end of the large-diameter gear 77 meshes with the front end of the coupling portion 74 of the developing coupling 67.

Figure 8:
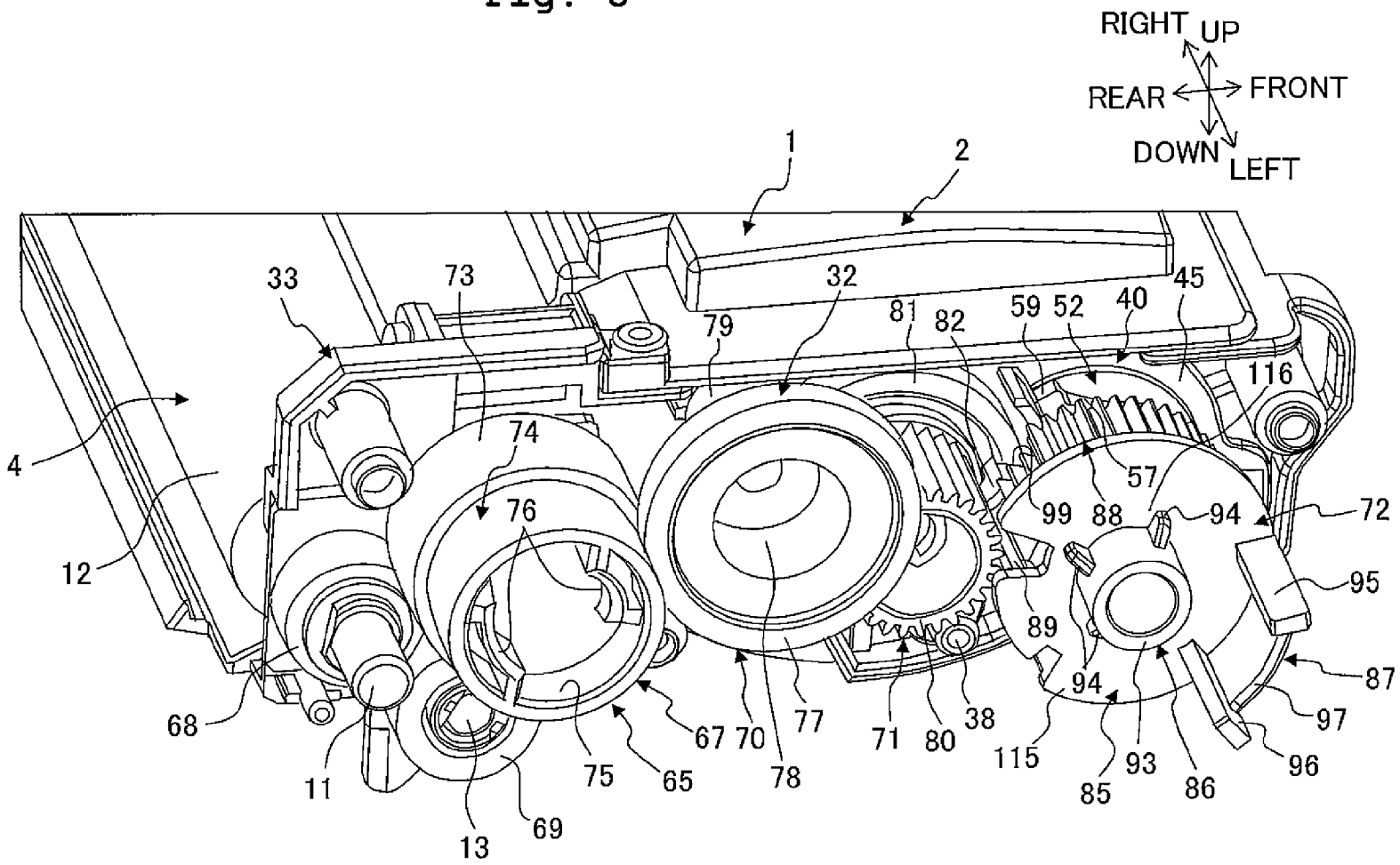
FIG. 8 is a perspective view of a gear row depicted in FIG. 6A as viewed from the upper left side and FIG. 8 depicts the state in which the first engaging portion of the agitator gear abuts against the second engaging portion of the detection gear at the initial position.

As depicted in FIG. 9A, the intermediate portion 78 has a substantially cylindrical shape of which central axis is coincident with that of the large-diameter gear 77. The intermediate portion 78 protrudes rightward from the right surface of the large-diameter gear 77. The outer diameter of the intermediate portion 78 is smaller than the outer diameter of the large-diameter gear 77. As depicted in FIG. 8, the inner diameter of the intermediate portion 78 is substantially the same as the inner diameter of the large-diameter gear 77. The inner circumferential surface of the intermediate portion 78 is substantially flush with the inner circumferential surface of the large-diameter gear 77. The right end surface of the intermediate portion 78 is closed.

As depicted in FIG. 9A, the small-diameter gear 79 has a substantially cylindrical shape of which central axis is coincident with that of the intermediate portion 78. The small-diameter gear 79 protrudes rightward from the right end surface of the intermediate portion 78. The outer diameter of the small-diameter gear 79 is smaller than the outer diameter of the intermediate portion 78. The inner diameter of the small-diameter gear 79 is slightly larger than the outer diameter of the idle gear support shaft 39. The small-diameter gear 79 has gear teeth along the entire circumference thereof.

As depicted in FIG. 4, the small-diameter gear 79 receives the idle gear support shaft 39 such that the idle gear support shaft 39 can rotate relative to the small-diameter gear 79, which enables the idle gear 70 to be rotatably supported by the left side wall 33. Accordingly, the idle gear 70 can rotate about a rotation axis A4 extending in the left-right direction as depicted in FIG. 7A.

<Agitator Gear>

The agitator gear 71 is positioned on the lower-front side of the idle gear 70. The agitator gear 71 has a substantially cylindrical shape extending in the left-right direction. The agitator gear 71 includes a first gear 81, a second gear 80, and a first engaging portion 82 as an exemplary engaging portion in an integrated manner.

As depicted in FIG. 9A, the first gear 81 is positioned at a right part of the agitator gear 71. The first gear 81 has a substantially annular shape in side view. The first gear 81 has gear teeth along the entire circumference thereof. The rear end of the first gear 81 meshes with the front end of the small-diameter gear 79 of the idle gear 70.

The second gear 80 is positioned at a left part of the agitator gear 71. The second gear 80 is adjacent to a left part of the first gear 81. That is, the second gear 80 and the first gear 81 are arranged in the left-right direction. The second gear 80 has a substantially cylindrical shape extending in the left-right direction. The central axis of the second gear 80 is coincident with that of the first gear 81. The outer diameter of the second gear 80 is smaller than the outer diameter of the first gear 81. A size L1 of the second gear 80 in the left-right direction is longer than a size L2 of the small-diameter gear 79 in the left-right direction. As depicted in FIG. 7A, the second gear 80 overlaps with the large-diameter gear 77 of the idle gear 70 when being projected in the left-right direction. The second gear 80 has gear teeth along the entire circumference thereof.

The first engaging portion 82 is positioned on the left side of the first gear 81. The first engaging portion 82 has a plate shape protruding leftward from the left surface of the first gear 81. As depicted in FIG. 7A, the first engaging portion 82 extends to be inclined counterclockwise in a radial direction of the agitator gear 71, when the agitator gear 71 is viewed from the left side. The inner end of the first engaging portion 82 in the radial direction of the agitator gear 71 continues to the outer periphery of the second gear 80. The outer end of the first engaging portion 82 in the radial direction of the agitator gear 71 extends to roots of gear teeth of the first gear 81. That is, the first engaging portion 82 extends from the outer periphery of the second gear 80 toward the inner periphery of the first gear 81.

The agitator gear 71 is attached to the left end of the agitator shaft 9 such that the agitator gear 71 cannot rotate relative to the agitator shaft 9. This allows the agitator gear 71 to rotate around a rotational axis A1 extending in the left-right direction.

The rear ends of the second gear 80 and the first gear 81 are positioned with spacing distances between the second gear 80 and the front end of the large-diameter gear 77 and between the first gear 81 and the front end of the large-diameter gear 77 in the left-right direction. The rear ends of the second gear 80 and the first gear 81 overlap with the front end of the large-diameter gear 77 when being projected in the left-right direction.

<Detection Unit>

As depicted in FIG. 4, the detection unit 110 includes the cap 40, a detection gear 72 as an exemplary detection target unit, and a spring 100.

<Cap>

Figure 5A:
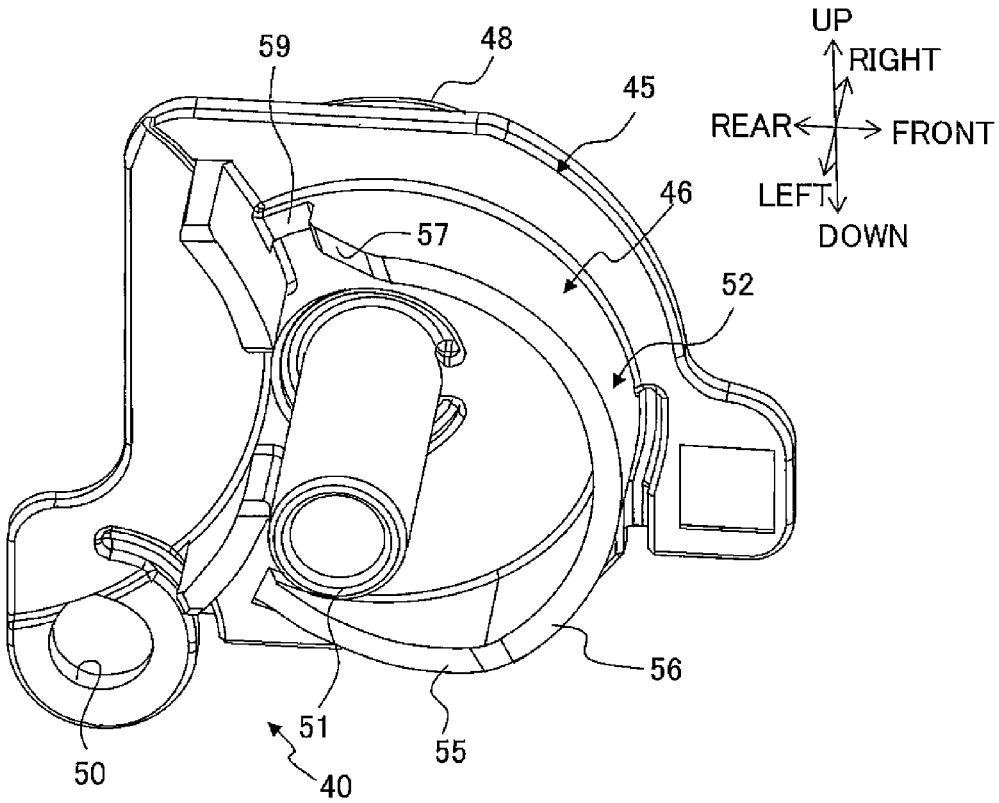
FIG. 5A is a perspective view of a cap depicted in FIG. 3 as viewed from the upper left side.

As depicted in FIG. 5A, the cap 40 includes a closing portion 45, an insertion portion 48, and a detection gear support portion 46 in an integrated manner.

The closing portion 45 has a substantially rectangular plate shape in side view. Further, the closing portion 45 includes a positioning hole 50.

The positioning hole 50 is positioned at a lower-rear end of the closing portion 45. The positioning hole 50 has a substantially circular shape in side view and penetrates the closing portion 45 in the left-right direction.

The insertion portion 48 is positioned on the right side of the closing portion 45. The insertion portion 48 has a substantially cylindrical shape extending in the left-right direction, and protrudes rightward from the right surface of the closing portion 45. The outer diameter of the insertion portion 48 is slightly larger than the inner diameter of the toner filling port 37.

The detection gear support portion 46 is positioned on the left side of the closing portion 45. The detection gear support portion 46 is provided with a detection gear support shaft 51 and a guide 52.

The detection gear support shaft 51 is positioned roughly in the center of the left surface of the closing portion 45. The detection gear support shaft 51 has a substantially cylindrical shape extending in the left-right direction, and protrudes leftward from the left surface of the closing portion 45.

The guide 52 has a substantially C-shape in side view in which the rear side thereof is open, and has a substantially semi-cylindrical shape extending in the left-right direction. The guide 52 protrudes leftward from the left surface of the closing portion 45. The guide 52 is positioned to encircle the detection gear support shaft 51 with a spacing distance between itself and the outer circumferential surface of the detection gear support shaft 51. The guide 52 includes a first inclined surface 55, a parallel surface 56, a second inclined surface 57, and a recess 59.

In a case that the left surface of the guide 52 is viewed from the left side, the first inclined surface 55 is positioned at the upstream end of the guide 52 in the counterclockwise direction and the first inclined surface 55 continues from the left surface of the closing portion 45. In the case that the left surface of the guide 52 is viewed from the left side, the first inclined surface 55 is inclined to protrude leftward toward the downstream side in the counterclockwise direction.

In the case that the left surface of the guide 52 is viewed from the left side, the parallel surface 56 is positioned at an intermediate part of the guide 52 in the counterclockwise direction. In the case that the left surface of the guide 52 is viewed from the left side, the parallel surface 56 continues from the downstream end of the first inclined surface 55 in the counterclockwise direction and extends in the counterclockwise direction to be parallel to the closing portion 45.

In the case that the left surface of the guide 52 is viewed from the left side, the second inclined surface 57 is positioned at the downstream end of the guide 52 in the counterclockwise direction and the second inclined surface 57 continues from the downstream end of the parallel surface 56 in the counterclockwise direction. In the case that the left surface of the guide 52 is viewed from the left side, the second inclined surface 57 is inclined to protrude leftward toward the upstream side in the counterclockwise direction.

The recess 59 is recessed rightward at the downstream end of the second inclined surface 57 in the counterclockwise direction as viewed from the left side. The recess 59 has a substantially rectangular shape in side view.

As depicted in FIG. 4, the cap 40 is attached to the left side wall 33 by inserting the insertion portion 48 into the protruding portion 36 and the toner filling port 37 and allowing the positioning hole 50 to receive the positioning portion 38. Accordingly, the toner filing port 37 is covered with the closing portion 45 from the left side as depicted in FIG. 3.

<Detection Gear>

As depicted in FIG. 7A, the detection gear 72 is positioned on the front side of the agitator gear 71. Transmitting the driving force from the agitator gear 71 makes the detection gear 72 irreversibly rotate, in a rotation direction R, from an initial position as an exemplary first position depicted in FIG. 9A to an end position as an exemplary second position depicted in FIGS. 7B and 10. As depicted by the arrow in FIG. 6A, the rotation direction R is the counterclockwise direction as viewed from the left side.

The following explanation about the detection gear 72 will be made assuming that the detection gear 72 is at the initial position as depicted in FIG. 9A.

Figure 5B:
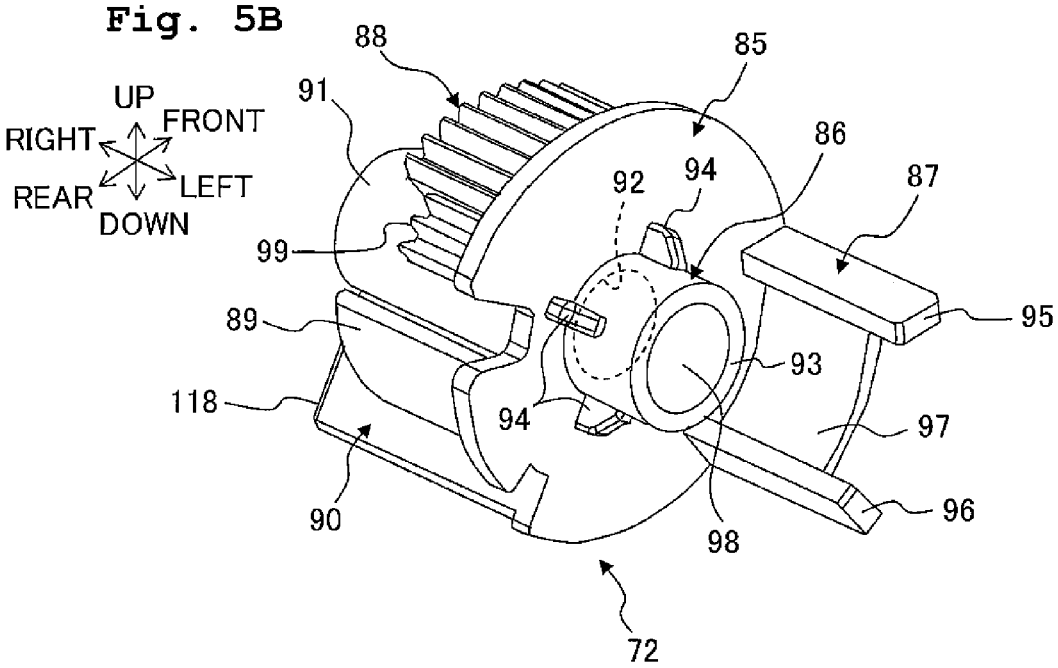
FIG. 5B is a perspective view of a detection gear depicted in FIG. 3 as viewed from the left rear side.

The detection gear 72 has a substantially cylindrical shape extending in the left-right direction and is made of known plastic. As depicted in FIG. 5B, the detection gear 72 includes a plate-shaped portion 85, a fastening portion 86, a detection target portion 87, a shaft insertion portion 91, a detection gear portion 88 as an exemplary detection target receiving portion, a guide rib 90, and a second engaging portion 89 in an integrated manner.

The plate-shaped portion 85 has a substantially circular plate form in side view. The plate-shaped portion 85 has an insertion hole 92 at a central part thereof. The insertion hole 92 has a substantially circular shape in side view and penetrates the plate-shaped portion 85 in the left-right direction. The inner diameter of the insertion hole 92 is slightly larger than the outer diameter of the detection gear support shaft 51.

The fastening portion 86 is positioned on the left side of the plate-shaped portion 85. The fastening portion 86 is provided with a boss 93 and a plurality of fastening projections 94.

The boss 93 has a substantially cylindrical shape of which central axis is coincident with that of the plate-shaped portion 85. The boss 93 protrudes leftward from the periphery of the insertion hole 92. The inner diameter of the boss 93 is substantially the same as the diameter of the insertion hole 92.

The fastening projections 94 are positioned with a spacing distance of approximately 90 degrees provided therebetween in a circumferential direction of the boss 93. Specifically, four fastening projections 94 are positioned with the spacing distance provided therebetween. Each of the fastening projections 94 has a substantially rectangular shape in side view, and protrudes outward from the outer circumferential surface of the right end of the boss 93 in a radial direction of the boss 93.

The detection target portion 87 is positioned on the left surface of the plate-shaped portion 85 at an outer part in a radial direction of rotation of the detection gear 72. The detection target portion 87 is provided with a first detection projection 95, a second detection projection 96, and a connection portion 97.

The first detection projection 95 is positioned on the front side of the boss 93 with a spacing distance intervening therebetween. The first detection projection 95 has a substantially rectangular-column shape extending in the left-right direction, and protrudes leftward from the periphery of the left surface of the plate-shaped portion 85. The first detection projection 95 extends in the radial direction of rotation of the detection gear 72 in side view. The outer end surface of the first detection projection 95 in the radial direction of rotation of the detection gear 72 is substantially flush with the outer circumferential surface of the plate-shaped portion 85.

The second detection projection 96 is positioned on the lower-front side of the boss 93 with a spacing distance intervening therebetween. The second detection projection 96 has a substantially rectangular-column shape extending in the left-right direction, and protrudes leftward from the periphery of the left surface of the plate-shaped portion 85. The second detection projection 96 extends in the radial direction of rotation of the detection gear 72 in side view. The size of the second detection projection 96 in the left-right direction is substantially the same as the size of the first detection projection 95 in the left-right direction. The outer end surface of the second detection projection 96 in the radial direction of rotation of the detection gear 72 is substantially flush with the outer circumferential surface of the plate-shaped portion 85.

The connection portion 97 is provided to span between the first detection projection 95 and the second detection projection 96 in a circumferential direction of rotation of the detection gear 72. The connection portion 97 has a substantially plate shape extending in the left-right direction, and protrudes leftward from the left surface of the plate-shaped portion 85. The size of the connection portion 97 in the left-right direction is shorter than the size of the first detection projection 95 in the left-right direction.

The shaft insertion portion 91 is positioned on the right side of the plate-shaped portion 85. The shaft insertion portion 91 has a substantially cylindrical shape of which central axis is coincident with that of the plate-shaped portion 85. The shaft insertion portion 91 protrudes rightward from the periphery of the insertion hole 92. The inner diameter of the shaft insertion portion 91 is substantially the same as the diameter of the insertion hole 92. Those defining a communicating hole 98 which extends in the left-right direction include the inner circumferential surface of the shaft insertion portion 91, the insertion hole 92, and the inner circumferential surface of the boss 93. As depicted in FIG. 4, the shaft insertion portion 91 fits into the detection gear support shaft 51. Specifically, the detection gear 72 is supported by the left side wall 33 via the cap 40 by letting the communicating hole 98 receive the detection gear support shaft 51 such that the detection gear support shaft 51 can rotate relative to the communicating hole 98. This allows the detection gear 72 to rotate with respect to the left side wall 33 with a rotation axis A2 as a rotation center as depicted in FIG. 6A.

As depicted in FIG. 5B, the detection gear portion 88 is positioned on the right side of the plate-shaped portion 85. As depicted in FIG. 6A, the detection gear portion 88 has a substantially semi-cylindrical shape of which central axis is coincident with that of the shaft insertion portion 91. The lower-rear side of the detection gear portion 88 is open in side view. The detection gear portion 88 protrudes rightward from the right surface of the plate-shaped portion 85. The detection gear portion 88 has gear teeth along the entire circumference thereof. The detection gear portion 88 is positioned to surround an upper-front part of the shaft insertion portion 91 with a spacing distance between itself and the upper-front part of the outer circumferential surface of the shaft insertion portion 91. The front ends of gear teeth of the detection gear portion 88 are positioned on the inside of outer periphery of the plate-shaped portion 85 in the radial direction of rotation of the detection gear 72. In other words, the outer periphery of the plate-shaped portion 85 is positioned on the outside of the front ends of gear teeth of the detection gear portion 88 in the radial direction of rotation of the detection gear 72. As depicted in FIG. 5B, the detection gear portion 88 includes a notch 99.

The notch 99 is positioned at a downstream end of the detection gear portion 88 in the rotation direction of the detection gear 72. The notch 99 has a substantially rectangular shape as viewed from the back side. The notch 99 is formed by cutting a right part of the downstream end of the detection gear portion 88 in the rotation direction of the detection gear 72.

As depicted in FIG. 6A, the guide rib 90 is positioned on the right side of the plate-shaped portion 85. The guide rib 90 is positioned on the lower-rear side of the boss 93 in side view. The guide rib 90 protrudes rightward from the right surface of the plate-shaped portion 85. The guide rib 90 has a substantially plate shape extending in the radial direction of rotation of the detection gear 72. As depicted in FIG. 5B, the size of the guide rib 90 in the left-right direction is longer than the size of the detection gear portion 88 in the left-right direction. A rubbing portion 118 is positioned at the right end of the guide rib 90. The rubbing portion 118 protrudes to curve or bend rightward. As depicted in FIG. 9A, the guide rib 90 is positioned on the upstream side of the first inclined surface 55 in the rotation direction of the detection gear 72 in a state that the detection gear 72 is positioned at the initial position.

As depicted in FIG. 5B and FIG. 6A, the second engaging portion 89 is positioned on the right side of the plate-shaped portion 85. The second engaging portion 89 is positioned on the lower-rear side of the boss 93 in side view with a spacing intervening therebetween. The second engaging portion 89 is positioned on the upstream side of the guide rib 90 in the rotation direction R. The second engaging portion 89 protrudes rightward from the right surface of the plate-shaped portion 85, and the second engaging portion 89 extends from the substantially center part of the guide rib 90 in side view toward the upstream in the rotation direction R. The second engaging portion 89 has a substantially arc shape in side view extending in the rotation direction R. The size of the second engaging portion 89 in the left-right direction is longer than the size of the detection gear portion 88 in the left-right direction and is shorter than the size of the guide rib 90 in the left-right direction.

<Spring>

As depicted in FIG. 4, the spring 100 is an air-core coil and extends in the left-right direction. The spring 100 is fastened to the detection gear 72 by fitting the fastening portion 86 (i.e., boss 93 and fastening projections 94) into the right end of the spring 100.

<Gear Cover>

As depicted in FIGS. 3 and 4, the gear cover 66 covers the gear row 65 and the detection unit 110 therewith from the left side. The gear cover 66 is provided with a first cover 101 and a second cover 102.

The first cover 101 is positioned at a rear part of the gear cover 66. The first cover 101 covers the developing coupling 67, the developing gear 68, and the supply gear 69 therewith from the left side. The first cover 101 has a substantially box shape in which the right side thereof is open. As depicted in FIG. 4, the first cover 101 includes a coupling exposure port 104.

The coupling exposure port 104 is positioned roughly in the center of the left wall of the first cover 101. The coupling exposure port 104 has a substantially circular shape in side view, and penetrates the left wall of the first cover 101 in the left-right direction. The connection recess 75 of the developing coupling 67 is exposed via the coupling exposure port 104 of the first cover 101, and the first cover 101 is screwed to a rear part of the left side wall 33 to collectively cover the coupling portion 74 of the developing coupling 67, the developing gear 68, and the supply gear 69 therewith.

The second cover 102 is positioned at a front part of the gear cover 66. The second cover 102 covers the idle gear 70, the agitator gear 71, and the detection gear 72 therewith from the left side. The second cover 102 has a substantially box shape in which the right side thereof is open. The second cover 102 is provided with a base 111, a peripheral wall 112 extending rightward from the base 111, and an accommodating portion 113 accommodating the detection gear 72.

The base 111 is a wall orthogonal to the left-right direction and extending in the front-rear direction. The base 111 is separated from the idle gear 70 and the agitator gear 71 in the left-right direction. The base 111 covers the idle gear 70 and the agitator gear 71 therewith from the left side.

The peripheral wall 112 extends rightward from the outer periphery of the base 111 to cover the idle gear 70, the agitator gear 71, and the detection gear 72 therewith in the up-down direction.

The accommodating portion 113 is positioned on the front side of the base 111. The accommodating portion 113 protrudes leftward from the front end of the base 111 to have a substantially cylindrical shape in the left-right direction. The accommodating portion 113 includes a through hole 105, a circumferential wall 106, a receiving portion 107, and a connection portion 108.

The through hole 105 is positioned at a front part of the left wall of the second cover 102. The through hole 105 has a substantially cylindrical shape in side view to penetrate the left wall of the second cover 102 in the left-right direction. The inner diameter of the through hole 105 is larger than the outer diameter of the plate-shaped portion 85.

The circumferential wall 106 protrudes leftward from the periphery of the through hole 105. The circumferential wall 106 has a substantially cylindrical shape in the left-right direction.

The receiving portion 107 is positioned within the circumferential wall 106 to have the central axis coincident with that of the circumferential wall 106. The receiving portion 107 extends in the left-right direction to have a substantially cylindrical shape of which left end is closed.

The connection portion 108 is positioned within the circumferential wall 106 under or below the receiving portion 107. The connection portion 108 connects the outer circumferential surface of the receiving portion 107 to the inner circumferential surface of the circumferential wall 106 in a radial direction of the circumferential wall 106.

Those defining a detection target portion through hole 109 include the inner circumferential surface of the circumferential wall 106, the outer circumferential surface of the receiving portion 107, and the front and rear surfaces of the connection portion 108. The detection target portion through hole 109 has a substantially C-shape in side view in which the lower side thereof is open. The detection target portion through hole 109 penetrates the second cover 102 in the left-right direction.

The detection gear 72 is positioned in the gear cover 66. Specifically, the plate-shaped portion 85 and the detection target portion 87 of the detection gear 72 are positioned in the circumferential wall 106 of the second cover 102. The left end surfaces of the first detection projection 95 and the second detection projection 96 are positioned on the slightly right side from the left end surface of the circumferential wall 106.

As depicted in FIG. 9A, a distance L4 between the gear cover 66 and the large-diameter gear 77 of the idle gear 70 is 1 mm or more and 8 mm or less. Specifically, the distance L4 is 4 mm.

The rear end of the plate-shaped portion 85 of the detection gear 72 is positioned between the second gear 80 of the agitator gear 71 and a virtual plane B which is a plane including the base 111 of the second cover 102.

As depicted in FIG. 4, the spring 100 is positioned between the receiving portion 107 of the gear cover 66 and the plate-shaped portion 85 of the detection gear 72. Specifically, one end of the spring 100 abuts against the receiving portion 107 of the gear cover 66, and the other end of the spring 100 abuts against the plate-shaped portion 85 of the detection gear 72, so that the spring 100 is positioned between the gear cover 66 and the detection gear 72 in a compressed state. The detection gear 72 is normally biased rightward, that is, toward the cap 40, by the biasing force of the spring 100.

<Details of Body Casing>

As depicted in FIG. 3 and FIG. 6A, the body casing 16 is provided with a body coupling 200 and a detecting mechanism 190 as an exemplary detecting apparatus.

As depicted in FIG. 3, the body coupling 200 is positioned with a spacing distance between itself and the connection recess 75 of the developing coupling 67 in the left-right direction, in a state that the developing cartridge 1 is installed to the body casing 16. The body coupling 200 has a substantially cylindrical shape extending in the left-right direction, and the right end of the body coupling 200 is configured to be insertable into the connection recess 75.

The body coupling 200 is configured to move in the left-right direction in cooperation with the opening/closing operation of the front cover 21 via a known interlocking or cooperative mechanism. The body coupling 200 is configured that the driving force from a driving source such as an unillustrated motor provided for the body casing 16 is transmitted thereto. When the driving force is transmitted to the body coupling 200, the body coupling 200 rotates in the clockwise direction as viewed from the left side.

As depicted in FIG. 6A, the detecting mechanism 190 is configured to detect the first detection projection 95 and the second detection projection 96. The detecting mechanism 190 is positioned with a spacing distance between itself and a front part of the developing cartridge 1 in the left-right direction, in a state that the developing cartridge 1 is installed to the body casing 16. The detecting mechanism 190 is provided with an actuator 191 and an unillustrated optical sensor.

The actuator 191 is provided with a swing shaft 193 and an abutting lever 192.

The swing shaft 193 has a substantially cylindrical shape extending in the left-right direction, and is rotatably supported by the body casing 16. The abutting lever 192 extends outward from the swing shaft 193 in a radial direction of the swing shaft 193. The actuator 191 is swingable between a detection position as depicted in FIG. 7A and a non-detection position. The detection position is a position at which the abutting lever 192 extends downward, and the non-detection position is a position at which the abutting lever 192 extends from the swing shaft 193 in a lower-front direction. The actuator 191 is normally positioned at the non-detection position by the biasing force of an unillustrated spring.

The unillustrated optical sensor is provided with a known light-emitting element and light-receiving element, and is configured to be capable of detecting the swing of the actuator 191. Specifically, the unillustrated optical sensor does not output an on-signal in a case that the actuator 191 is positioned at the non-detection position, and the unillustrated optical sensor outputs the on-signal in a case that the actuator 191 is positioned at the detection position.

<Detection of New or Unused Developing Cartridge>

Subsequently, an explanation will be made about a detection operation of the developing cartridge 1 with reference to FIGS. 7A to 10. In FIGS. 7A to 10, the spring 100 and the detailed construction of the gear cover 66 are omitted for the convenience of explanation.

As depicted in FIG. 9A, the detection gear 72 is positioned at the initial position before a new developing cartridge 1 is used, that is, in a state that the developing cartridge 1 is unused.

As depicted in FIG. 9A, in the state that the detection gear 72 is positioned at the initial position, the downstream end of the detection gear 72 in the rotation direction does not mesh with the second gear 80 of the agitator gear 71 and is separated from the second gear 80 in the upper-front direction. The rubbing portion 118 of the guide rib 90 is brought into contact with the closing portion 45 of the cap 40 from the left side.

In order to install such a new developing cartridge 1 to the body casing 16, an operator opens the front cover 21 as depicted in FIG. 2. Then, the operator inserts the developing cartridge 1 to the body casing 16 via the opening 20 on the front side of the body casing 16. After that, the operator closes the front cover 21.

When the front cover 21 is closed, the body coupling 200 provided for the body casing 16 goes into the connection recess 75 of the coupling portion 74 such that the body coupling 200 cannot rotate relative to the connection recess 75, and the body coupling 200 is engaged with the projections 76 by the known interlocking mechanism (not depicted), as depicted in FIG. 3.

After the body coupling 200 is engaged with the projections 76, an unillustrated control unit provided for the body casing 16 starts a warm-up operation of the printer 15.

In the warm-up operation, the body coupling 200 inputs the driving force to the coupling portion 74 of the developing coupling 67. Then, the developing coupling 67 rotates in the clockwise direction as viewed from the left side. In this situation, the developing coupling 67 transmits the driving force to various gears meshing with the coupling gear 73 those of which include the developing gear 68, the supply gear 69, and the large-diameter gear 77 of the idle gear 70.

In a case that the driving force is transmitted to the developing gear 68 and the supply gear 69, the developing roller 4 and the supply roller 5 rotate in the counterclockwise direction as viewed from the left side, respectively.

In a case that the driving force is transmitted to the large-diameter gear 77, the idle gear 70 rotates in the counterclockwise direction as viewed from the left side to transmit the driving force to the first gear 81 of the agitator gear 71 meshing with the small-diameter gear 79, as depicted in FIG. 9A. Then, the agitator gear 71 rotates in the clockwise direction as viewed from the left side as depicted in FIG. 6A. Further, the first engaging portion 82 moves in accordance with the rotation of the agitator gear 71 and passes through a notched part of the notch 99 of the detection gear 72 as depicted in FIGS. 6A and 8.

After that, the first engaging portion 82 abuts against the upstream end of the second engaging portion 89 of the detection gear 72 in the rotation direction R, and presses the upstream end of the second engaging portion 89 in the rotation direction R in a lower-front direction.

Figure 6B:
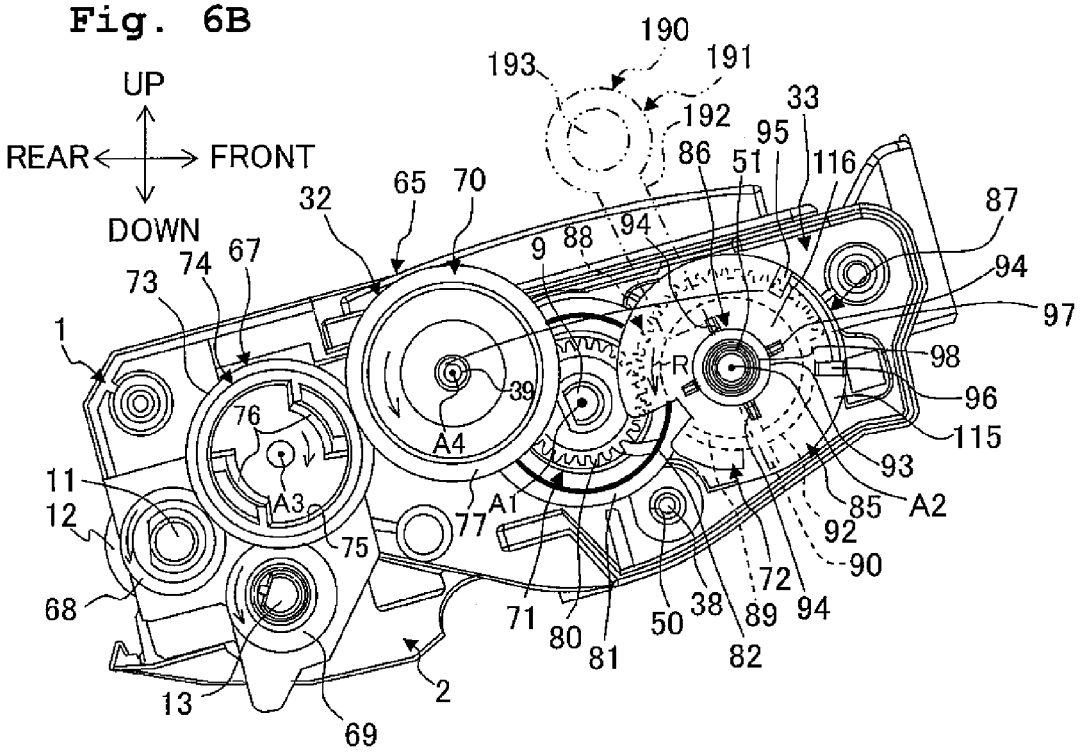
FIG. 6B is another illustrative view, continued from FIG. 6A, illustrating the new cartridge detection operation of the detection unit and depicting a state in which a first gear of the agitator gear meshes with a detection gear portion of the detection gear.

The pressing of the first engaging portion 82 causes the detection gear 72 at the initial position to rotate in the rotation direction R. The rotation of the detection gear 72 makes the downstream end of the detection gear portion 88 in the rotation direction R mesh with the front end of the second gear 80 as depicted in FIG. 6B.

Subsequently, in a case that the agitator gear 71 rotates, the detection gear portion 88 receives the driving force from the second gear 80 to further rotate the detection gear 72 in the rotation direction R.

In accordance with the rotation of the detection gear 72, the rubbing portion 118 of the guide rib 90 moves toward the parallel surface 56 while rubbing itself against the first inclined surface 55, and at the same time the rubbing portion 118 gradually moves leftward against the biasing force of the spring 100. In a case that the rubbing portion 118 of the guide rib 90 of the detection gear 72 arrives at the parallel surface 56, the detection gear 72 is positioned at an advancing position which is farthest away from the left side wall 33 in the left-right direction.

In this situation, respective left ends of the first detection projection 95 and the second detection projection 96 protrude leftward beyond the left end surface of the circumferential wall 106 via the detection target portion through hole 109 of the second cover 102.

In a case that the detection gear 72 at the advancing position rotates, the rubbing portion 118 of the guide rib 90 moves in the rotation direction R while rubbing against the parallel surface 56. The first detection projection 95 moves in the rotation direction R as depicted in FIG. 7A. Then, the first detection projection 95 abuts against the lower end of the abutting lever 192 from the front side to press the lower end of the abutting lever 192 rearward. Further, the actuator 191 swings from the non-detection position to the detection position. This causes the unillustrated optical sensor to detect the swing of the actuator 191 from the non-detection position to the detection position and to output the on-signal. Accordingly, the detecting mechanism 190 detects the first detection projection 95.

In a case that the detection gear 72 further rotates, the first detection projection 95 is separated from the abutting lever 192 and the actuator 191 returns to the non-detection position from the detection position. As a result, the unillustrated optical sensor detects the swing of the actuator 191 from the detection position to the non-detection position and stops the output of the on-signal.

Subsequently, in a case that the detection gear 72 still further rotates, the second detection projection 96 abuts against the lower end of the abutting lever 192 from the front side to press the lower end of the abutting lever 192 rearward. Further, the actuator 191 again swings from the non-detection position to the detection position. This causes the unillustrated optical sensor to detect the swing of the actuator 191 from the non-detection position to the detection position and to output the on-signal. Accordingly, the detecting mechanism 190 detects the second detection projection 96.

Figure 7B:
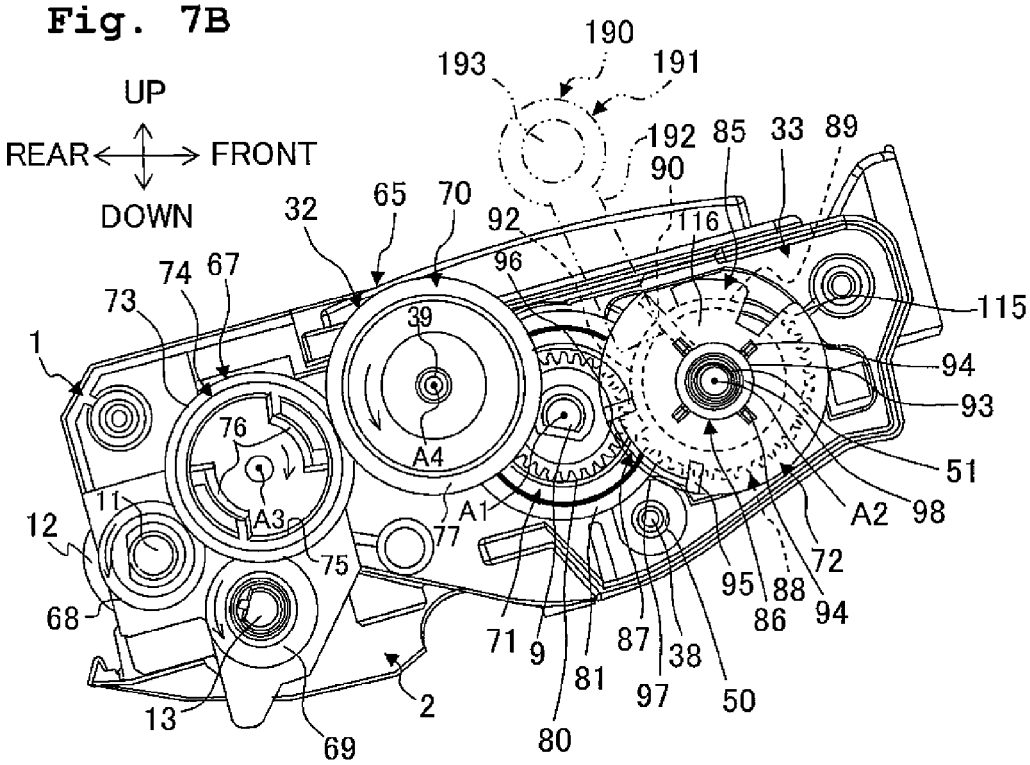
FIG. 7B is yet another illustrative view, continued from FIG. 7A, illustrating the new cartridge detection operation of the detection unit and depicting a state in which the detection gear is positioned at an end position.

Subsequently, in a case that the detection gear 72 yet further rotates, the second detection projection 96 is separated from the abutting lever 192 as depicted in FIG. 7B and the actuator 191 returns again to the non-detection position from the detection position. As a result, the unillustrated optical sensor detects the swing of the actuator 191 from the detection position to the non-detection position and stops the output of the on-signal.

Figure 10:
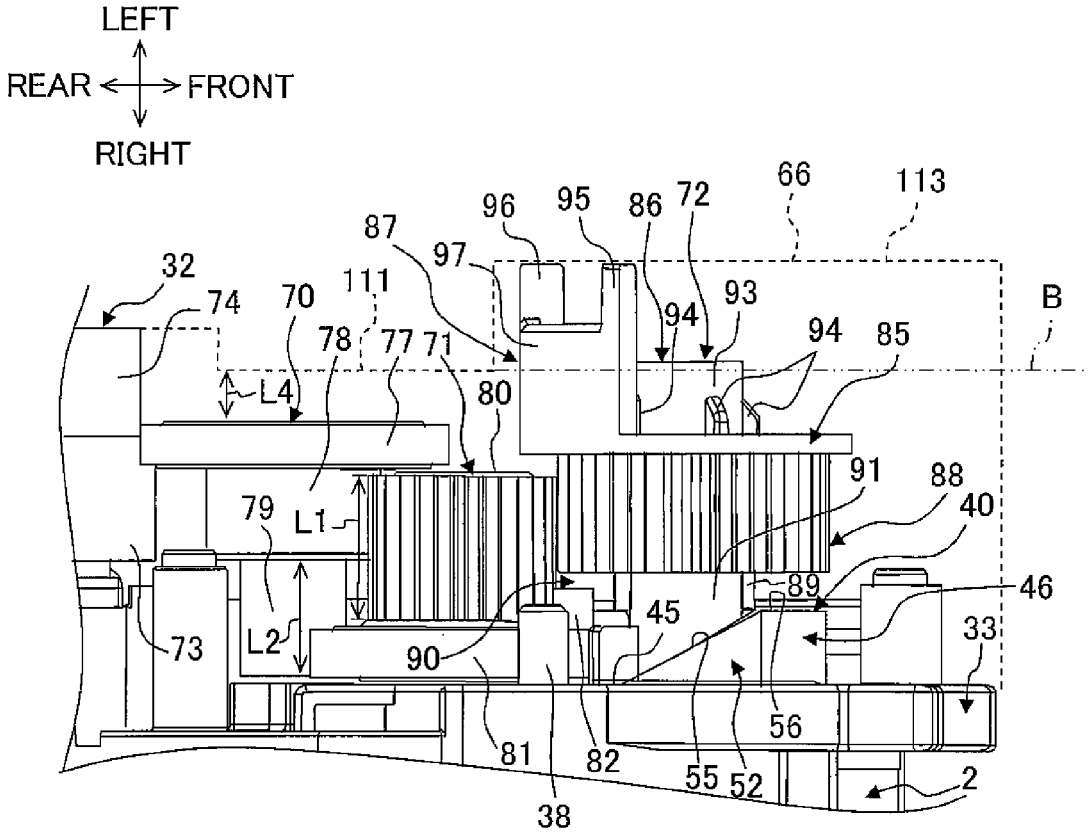
FIG. 10 is a bottom view of a gear row depicted in FIG. 7B

In this situation, the first detection projection 95 and a part of the connection portion 97 move to pass on the left side of the front end of the second gear 80 as depicted in FIG. 10. That is, the first detection projection 95 and the part of the connection portion 97 move to pass between the second gear 80 and the virtual plane B which is the plane including the base 111 of the gear cover 66. In other words, the movement locus of the first detection projection 95 and the part of the connection portion 97 overlaps with the second gear 80 when being projected in the left-right direction.

Subsequently, in a case that the detection gear 72 yet further rotates, the rubbing portion 118 of the guide rib 90 reaches the second inclined surface 57 from the parallel surface 56. The rubbing portion 118 gradually moves rightward while rubbing against the second inclined surface 57, so that the rubbing portion 118 faces the recess 59 in the left-right direction. This causes the detection gear 72 to move rightward at once by the biasing force of the spring 100 to make the rubbing portion 118 of the guide rib 90 contact with the left surface of the recess 59. As a result, the first detection projection 95 and the second detection projection 96 move rightward as depicted in FIG. 3, and respective left end surfaces of the first detection projection 95 and the second detection projection 96 are positioned to substantially flush with the left end surface of the circumferential wall 106.

In this situation, the engagement between the detection gear portion 88 of the detection gear 72 and the second gear 80 of the agitator gear 71 is released to stop the rotation of the detection gear 72 as depicted in FIG. 7B. Accordingly, the detection gear 72 is positioned at the end position at the time of the end of the rotation.

The second detection projection 96 is positioned to overlap with the front end of the second gear 80 of the agitator gear 71 as viewed from the left side in a state that the detection gear 72 is positioned at the end position.

That is, the second detection projection 96 is positioned between the gear cover 66 and the second gear 80. The first detection projection 95 is positioned with a spacing distance between itself and the agitator gear 71 in the lower-front direction.

As described above, in the case that the new or unused developing cartridge 1 is installed to the body casing 16 for the first time, the unillustrated optical sensor outputs the on-signal twice. Thus, in the case that the unillustrated optical sensor outputs the on-signal twice after the developing cartridge 1 is installed to the body casing 16, an unillustrated microcomputer judges that the developing cartridge 1 is new. In this procedure, the plate-shaped portion 85 of the detection gear 72 moves between the second gear 80 and the virtual plane B which is the plane including the base 111 of the gear cover 66.

[Action and Effect]

According to the developing cartridge 1, the detection gear 72 includes the first detection projection 95 and the second detection projection 96 as depicted in FIG. 5B.

Thus, it is possible to appropriately detect as to whether or not the developing cartridge is new by detecting the movements of the first detection projection 95 and the second detection projection 96 by use of the detecting mechanism 190.

As depicted in FIG. 10, the first detection projection 95 and the connection portion 97 move between the second gear 80 and the gear cover 66 as viewed from the lower side.

This makes it possible to use a space between the second gear 80 and the gear cover 66 effectively. Thus, the developing cartridge 1 can be downsized.

According to the developing cartridge 1, the plate-shaped portion 85 of the detection gear 72 moves between the second gear 80 and the virtual plane B which is the plane including the base 111 of the gear cover 66 as depicted in FIG. 10. Therefore, it is possible to use a space between the virtual plane B and the second gear 80 effectively.

Figure 9B:
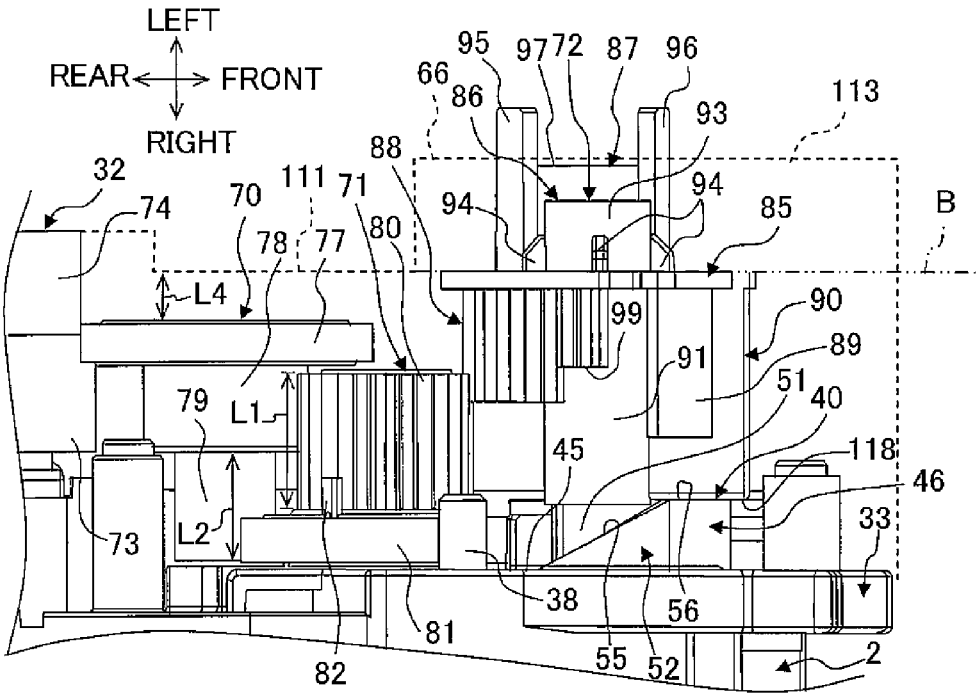
FIG. 9B is a bottom view of a gear row depicted in FIG. 6B

According to the developing cartridge 1, the detection gear 72 moves (advances/retreats) in the left-right direction as depicted in FIG. 9B. Therefore, the developing cartridge 1 can be downsized in the front-rear direction or the up-down direction while securing the movement area of the detection gear 72.

According to the developing cartridge 1, as depicted in FIG. 6A, the agitator gear 71 is provided with the first engaging portion 82 to be engaged with the second engaging portion 89 of the detection gear 72 positioned at the initial position. The detection gear 72 is configured to allow the detection gear portion 88 to be brought in contact with the second gear 80 after the second engaging portion 89 is engaged with the first engaging portion 82. Therefore, the detection gear portion 88 can be brought into contact with the second gear 80 reliably.

Further, the first engaging portion 82 is provided on the left surface of the first gear 81. This makes it possible to use a space on the left side of the first gear 81 effectively. As a result, the developing cartridge 1 can be downsized in the front-rear direction or the up-down direction.

According to the developing cartridge 1, the first engaging portion 82 extends from the outer periphery of the second gear 80 toward the outer periphery of the first gear 81 as depicted in FIG. 6B. Thus, the first engaging portion 82 can extend in a direction intersecting the rotation direction R of the detection gear 72. This makes it possible to sufficiently secure the engagement area of the first engaging portion 82 with the second engaging portion 89 of the detection gear 72. Therefore, the first engaging portion 82 can be engaged with the second engaging portion 89 of the detection gear 72 reliably.

According to the developing cartridge 1, the first gear 81 and the second gear 80 are positioned to be adjacent to each other in the left-right direction as depicted in FIG. 9A. Therefore, the first gear 81 and the second gear 80 can be positioned while space is used effectively.

According to the developing cartridge 1, in the idle gear 70, the small-diameter gear 79 and the large-diameter gear 77 are arranged in the left-right direction as depicted in FIG. 9A. The large-diameter gear 77 overlaps with the second gear 80 of the agitator gear 71 when being projected in the left-right direction.

This makes it possible to position the small-diameter gear 79, the large-diameter gear 77, and the second gear 80 while space is effectively used. As a result, the agitator gear 71 and the idle gear 70 can be positioned closely to each other in the front-rear direction and the up-down direction, which results in the downsizing of the developing cartridge 1.

According to the developing cartridge 1, the size L1 of the second gear 80 of the agitator gear 71 in the left-right direction is longer than the size L2 of the small-diameter gear 79 of the idle gear 70 in the left-right direction as depicted in FIG. 9A.

Thus, it is possible to sufficiently secure the contact area between the second gear 80 of the agitator gear 71 and the detection gear portion 88 of the detection gear 72. As a result, the second gear 80 of the agitator gear 71 can be brought into contact with the detection gear portion 88 of the detection gear 72 reliably.

According to the developing cartridge 1, as depicted in FIG. 9A, the distance L4 between the large-diameter gear 77 of the idle gear 70 and the gear cover 66 in the left-right direction is 1 mm or more and 8 mm or less. Specifically, the distance L4 is 4.4 mm. Thus, it is possible to secure a space between the idle gear 70 and the gear cover 66.

According to the developing cartridge 1, the detection gear portion 88 of the detection gear 72 has the gear teeth along the entire circumference thereof as depicted in FIG. 10. Thus, the driving force from the agitator gear 71 can be reliably transmitted to the detection gear 72 by a simple structure.

According to the developing cartridge 1, the movement locus of the detection target portion 87 of the detection gear 72 overlaps with the second gear 80 of the agitator gear 71 when being projected in the left-right direction as depicted in FIG. 7B. Therefore, the developing cartridge 1 can be downsized in the front-rear direction or the up-down direction.

[Modifications]

In the above embodiment, the agitator 3 is described as an exemplary agitation member. Instead of using the agitator 3, it is possible to use, as the agitation member, an auger screw, a belt-like agitation member, or the like.

In the above embodiment, the developing cartridge 1 is configured to include the developing roller 4. The developing cartridge 1 may be configured to include a developing sleeve, a brush-shaped roller, or the like in place of the developing roller 4.

In the above embodiment, the detection target portion 87 and the detection gear portion 88 are formed integrally in the detection gear 72. The detection target portion 87 may be configured as another member.

In the above embodiment, the detection gear portion 88 is described as the exemplary detection target receiving portion. In place of the detection gear portion 88, a belt-like member made of rubber may be used as the detection target receiving portion.

In the above embodiment, the second cover 102 is configured to cover the idle gear 70, the agitator gear 71, and the detection gear 72 therewith. The second cover 102 may be configured to cover at least a part of the idle gear 70, the agitator gear 71, and the detection gear 72 therewith.

In the above embodiment, the first cover 101 is formed separately from the second cover 102. In place of this configuration, the first cover 101 and the second cover 102 may be formed integrally.

In the above embodiment, the detection gear 72 is configured to be supported by the detection gear support shaft 51 of the cap 40. The detection gear 72 may be configured to be supported by the housing 2.

In the above embodiment, the detection gear 72 is supported by the detection gear support shaft 51 of the cap 40. The detection gear 72 may be configured to be supported by the second cover 102.

In the above embodiment, the detection target portion 87 is configured to include the first detection projection 95 and the second detection projection 96. The detection target portion 87 may be configured to include any one of the first detection projection 95 and the second detection projection 96.

In the above embodiment, each of the first detection projection 95 and the second detection projection 96 is the projection having the substantially rectangular-cylinder shape. Each of the first detection projection 95 and the second detection projection 96 may be formed as a projection having a substantially arc shape extending in the rotation direction of the detection gear 72.

In the above embodiment, the cap 40 is configured to include the guide 52. In place of this configuration, the housing 2 may be configured to include the guide 52.

In the above embodiment, the base 111 of the second cover 102 is formed orthogonally to the left-right direction. The base 111 of the second cover 102, however, may not be formed exactly orthogonally to the left-right direction. That is, the base 111 of the second cover 102 may be configured to incline toward the left side wall 33 without interfering with the rotation of each gear.

What is claimed is:

1. A developing cartridge, comprising:

a housing including a side wall and configured to contain a developer therein;

an agitation member configured to be rotatable around a rotational shaft extending in a first direction and to agitate the developer;

an agitation gear including a first gear and a second gear and fixed to the agitation member, the first gear being configured to receive driving force to be inputted and to transmit the driving force to the second gear, the second gear being positioned at a position farther from the side wall than the first gear in the first direction, the first gear and the second gear being rotatable around the rotational shaft;

a detection unit including: a detection receiving portion configured to mesh with the second gear and to receive the driving force from the second gear; a detection portion configured to be detected by an external detecting apparatus; and a plate-shaped portion configured to be connected to the detection portion on one side in the first direction and to the detection receiving portion on the other side in the first direction, the detection portion being a protrusion extending in the first direction; and a gear cover configured to cover at least a part of the agitation gear and the detection unit therewith and including a base facing the agitation gear in the first direction, wherein a connecting surface of the detection portion to the plate-shaped portion is configured to move between the second gear and the base, when being projected in a direction orthogonal to the first direction.

2. The developing cartridge according to claim 1, wherein the gear cover base is orthogonal to the first direction, and the detection unit is configured to move between a virtual plane in which the base extends and the second gear.

3. The developing cartridge according to claim 1, wherein the detection unit is configured to advance and retreat in the first direction by the driving force transmitted from the agitation gear.

4. The developing cartridge according to claim 3, wherein the detection unit is configured to move from a first position to a second position irreversibly, in a case that the detection unit is positioned at the first position, the detection receiving portion is separated from gear teeth of the second gear in a rotation direction of the second gear, the agitation gear includes an engagement portion configured to be engaged with the detection unit positioned at the first position at the time of rotation, the detection unit is configured to cause the detection receiving portion to contact with the second gear after the detection unit is engaged with the engagement portion, an outer diameter of the second gear is smaller than an outer diameter of the first gear, and the engagement portion is provided on an end surface of the first gear on the one side in the first direction.

5. The developing cartridge according to claim 4, wherein the engagement portion extends from an outer periphery of the second gear to an outer periphery of the first gear.

6. The developing cartridge according to claim 5, wherein the first gear is adjacent to the second gear in the first direction.

7. The developing cartridge according to claim 6, further comprising:

a coupling configured to receive driving force from an outside; and a driving transmission gear configured to transmit the driving force from the coupling to the agitation gear, wherein the driving transmission gear comprises a third gear and a fourth gear which are arranged in the first direction, the third gear is configured to mesh with the first gear of the agitation gear, the fourth gear is configured to receive the driving force from the coupling, and the fourth gear overlaps with the second gear when being projected in the first direction.

8. The developing cartridge according to claim 7, wherein a size of the second gear in the first direction is longer than a size of the third gear in the first direction.

9. The developing cartridge according to claim 8, wherein a spacing distance between the driving transmission gear and the gear cover in the first direction is 1 mm or more and 8 mm or less.

10. The developing cartridge according to claim 9, wherein the detection receiving portion is configured as gear teeth.

11. The developing cartridge according to claim 10, wherein a movement locus of the detection portion overlaps with the second gear when being projected in the first direction.

12. A developing cartridge comprising:

a housing including a first wall and a second wall and being configured to contain a developer therein, the second wall being separated from the first wall in a first direction;

a coupling configured to receive driving force from an outside and to rotate around a first rotational axis along the first direction;

an agitation member including a rotational shaft which extends in the first direction and being configured to agitate the developer in the housing;

an agitation gear including a first gear and a second gear which are arranged in the first direction and being configured to be supported by the rotational shaft of the agitation member to transmit the driving force to the agitation member, the second gear being positioned at a position farther from the first wall than the first gear in the first direction, the first gear and the second gear being rotatable around the rotational shaft;

a driving transmission gear including a third gear and a fourth gear which are arranged in the first direction and being configured to rotate around a second rotational axis along the first direction to transmit the driving force from the coupling to the agitation gear, the third gear being configured to mesh with the first gear, the fourth gear being configured to mesh with the coupling;

a detection unit including a detection receiving portion, detection portion, and a plate-shaped portion and being configured to rotate around a third rotational axis along the first direction, the detection receiving portion being configured to mesh with the second gear and to receive the driving force from the second gear, the detection portion being a protrusion extending in the first direction and configured to be detected by an external detecting apparatus, the plate-shaped portion being configured to be connected to the detection portion on one side in the first direction and to the detection receiving portion on the other side in the first direction; and a gear cover configured to cover at least a part of the detection unit, the agitation gear, and the driving transmission gear therewith and including a base facing the agitation gear in the first direction, wherein the fourth gear overlaps with the second gear when being projected in the first direction, and a connecting surface of the detection portion to the plate-shaped portion is configured to move between the second gear and the base, when being projected in a direction orthogonal to the first direction.

13. The developing cartridge according to claim 12, wherein a movement locus of the detection target portion overlaps with the second gear when being projected in the first direction.

* * * * *